US006990757B2

(12) United States Patent
Takemura et al.

(10) Patent No.: US 6,990,757 B2
(45) Date of Patent: Jan. 31, 2006

(54) WHEELED WORK VEHICLE

(75) Inventors: Toshihiko Takemura, Sakai (JP); Ryohei Sumiyoshi, Sakai (JP)

(73) Assignee: Kubota Corporation, Osaka (JP)

( * ) Notice: Subject to any disclaimer, the term of this patent is extended or adjusted under 35 U.S.C. 154(b) by 0 days.

(21) Appl. No.: 10/793,687

(22) Filed: Mar. 4, 2004

(65) Prior Publication Data

US 2005/0034336 A1 Feb. 17, 2005

(30) Foreign Application Priority Data

Aug. 12, 2003 (JP) ..... 2003-292220

(51) Int. Cl.
*B66C 23/00* (2006.01)
*E02F 3/00* (2006.01)

(52) U.S. Cl. ..... 37/347; 37/410; 37/417; 37/443; 180/89.1

(58) Field of Classification Search ..... 37/347, 37/403, 417, 443, 466, 410, 903; 414/687, 414/694, 719; 180/9.1, 89.1, 6.64, 6.7
See application file for complete search history.

(56) References Cited

U.S. PATENT DOCUMENTS 3,738,442 A * 6/1973 Eiler ..... 180/312
4,771,855 A * 9/1988 Takashima et al. ..... 180/326
5,909,780 A * 6/1999 De Andrade ..... 180/9.58
6,266,901 B1 * 7/2001 Kanda et al. ..... 37/403
2003/0226293 A1 12/2003 Takemura et al.

FOREIGN PATENT DOCUMENTS

JP 2001-97017 4/2001

* cited by examiner

*Primary Examiner*—Christopher J. Novosad
(74) *Attorney, Agent, or Firm*—The Webb Law Firm

(57) ABSTRACT

A wheeled work vehicle includes a traveling body including front and rear wheels, a traveling drive unit having an engine and a power transmission mechanism, a fuel tank, a work oil tank, and a vehicle frame mounting the front and rear wheels, the traveling drive unit, the fuel tank and the work oil tank. The vehicle includes a swivel base disposed upwardly of the traveling body and mounted via a swivel bearing on the traveling body, a driver's seat mounted on a rear portion of the swivel base, a steering unit disposed forwardly of the driver's seat and a ground-work implement supported on an implement support unit. The vehicle frame includes a front region mounting a front-wheel suspension unit for the front wheels, a rear region mounting a rear-wheel suspension unit for the rear wheels and an intermediate region supporting the swivel bearing.

18 Claims, 22 Drawing Sheets

WHEELED WORK VEHICLE

BACKGROUND OF THE INVENTION

1. Field of the Invention

The present invention relates to a wheeled work vehicle including front and rear wheels and a swiveling ground-work implement.

2. Description of the Related Art

A conventional art of the above type is known from Japanese Patent Application "Kokai" No. 2001-97017. In this, a traveling body having front and rear wheels mounts a swivel base via a swivel bearing and the swivel base mounts thereon an upper structure having a driver's seat and a steering unit and mounts also a ground-work implement having a liftable work tool. An engine as a portion of the upper structure is mounted on the swivel base and the driver's seat is disposed immediately above a swivel shaft. With this conventional art, the top face of the traveling body is formed flat and located higher than upper ends of the front and rear wheels and the engine is mounted on the swivel base as described above. Hence, the upper structure includes a fuel tank, a work oil tank, a hydraulic unit etc. In operation, as the engine drives a hydraulic pump, the pump feeds its work oil to a traveling hydraulic motor mounted on the traveling body, so that the front and rear wheels are driven via a transmission mechanism.

The above-described conventional vehicle is capable of traveling at a high speed on the road with its front and rear wheels and capable also of effecting such ground work as digging with swiveling the ground-work implement and also lifting up/down its work tool. However, as the engine is mounted on the swivel base, the upper structure significantly projects rearward, thus presenting an extremely large distance from the swivel shaft to the rear end of the structure. Moreover, this rear end further projects significantly from the rear ends of the rear wheel. As a result, traveling stability cannot be obtained and also a swiveling operation within a limited space is very difficult.

Moreover, the swivel base mounts thereon not only the engine, but also other components as the fuel tank, the oil tank, the hydraulic unit, etc., so that the center of gravity of the vehicle is located at a relatively high level. This makes improvement in the traveling stability difficult. And, the significant total mass of the upper structure makes improvement in the swiveling operability difficult.

In addition, the ground-work implement can effect only vertical pivotal movements. Hence, even with swiveling of the swivel base, the ground work is possible only forwardly of the driver's seat. Hence, this conventional vehicle cannot cope with a work such as a side ditch digging for digging the ground near a wall or the like which is effected typically by a backhoe. Consequently, this conventional vehicle is disadvantageous in being limited in the type of work possible as well as in presenting significant difficulty in a digging operation within a limited space.

SUMMARY OF THE INVENTION

In view of the above, a primary object of the present invention is to provide a wheeled work vehicle capable of solving the above-described disadvantages of the prior art. More particularly, with the wheeled work vehicle proposed by the invention, the engine and engine-related components are mounted at a rear portion of the traveling body, thereby to achieve weight reduction in the upper structure as well as reduction in the dimension of the upper structure from the swivel bearing to the rear end of the structure. Further, the ground-work implement is made capable also of pivoting in the right/left direction. Moreover, the vehicle allows for improvement in the traveling stability and/or swiveling operability.

For accomplishing the above-noted object, a wheeled work vehicle, according to the present invention, comprises:

a traveling body including front and rear wheels, a traveling drive unit having an engine and a power transmission mechanism, a dozer unit disposed at least at a front portion of front and rear portions of the body, a fuel tank, a work oil tank, and a vehicle frame mounting said members of the traveling body;

a swivel base disposed upwardly of the traveling body and mounted via a swivel bearing on the traveling body to be swivelable for full-angle swiveling movement relative thereto;

a driver's seat mounted at a rear portion of the swivel base;

a steering unit disposed forwardly of the driver's seat; and a ground-work implement supported on an implement support unit disposed erect on a front portion of the swivel base to be pivotable in the right/left direction;

wherein said vehicle frame includes an intermediate frame portion located between the front and rear wheels and supporting said swivel bearing and front and rear frame portions each located at a ground level higher than said intermediate frame portion; and said front frame portion mounts a front-wheel suspension unit for the front wheels and said rear frame portion mounts a rear-wheel suspension unit for the rear wheels.

With this construction, the swivel base is disposed at a position lower than the highest position of the traveling body, whereby the swivel base can be swiveled for full angle relative to the body and also the traveling body is made positively heavier whereas the upper portion of the swivel base is made positively lighter. Further, the ground-work implement is supported to an upper portion of the swivel base and is made capable of pivoting in the right/left direction. Consequently, the construction achieves improvements in the traveling stability, ground-work stability, swiveling operability as well as compactness of the vehicle in both vertical and fore/aft directions. The construction also makes it possible to secure greater readiness in driver's getting on/off the vehicle as well as increased roominess for the driver and simplicity in the entire vehicle construction.

In order to realize the above-described characterizing features of the present invention, the invention further proposes a specific construction for the vehicle frame as the core component of the traveling body. In this, the vehicle frame includes right and left side frames, a front frame acting as a cross beam for interconnecting the right and left side frames at front portions thereof with a predetermined distance therebetween and a rear frame acting as a further cross beam for interconnecting the right and left side frames at rear portions thereof with a predetermined distance therebetween. Further, each of the two side frames includes an a horizontal intermediate portion located at an intermediate portion of the side frame, a horizontal rear portion located at a rear portion of the side frame and having a higher ground level than the intermediate portion, a horizontal front portion located at a front portion of the side frame and having a higher ground level than the intermediate portion, a rear transition portion connecting a rear end of the intermediate portion and the rear portion, and a front transition portion connecting a front end of the intermediate portion and the front portion.

More preferably, it is further proposed to increase a distance between the right and left intermediate portions relative to a distance between the front portions and also to a distance between the rear portions. Further, the front portions may have a higher ground level than the rear portions. All of these proposed constructions contribute to further reduction in the weight of the upper structure and reduction in the distance between the swivel bearing to the rear end of the upper structure, thus contributing to further improvement in the traveling stability and/or swiveling operability.

According to one preferred embodiment of the present invention, the traveling body mounts the fuel tank on one of right and left sides between the front and rear wheels and mounts the work oil tank on the other side of the same. This construction contributes to improvement in the weight balance of the traveling body in the right/left and fore/aft directions as well as in compact and reasonable arrangements of the fuel tank, the oil tank and the other mounted components.

According to a further preferred embodiment of the present invention, the fuel tank is mounted on either one of the right and left intermediate portions of the traveling body and the work oil tank is mounted on the other of the right and left intermediate portions. This facilitates mounting/dismounting of the fuel tank and the oil tank and the front and rear wheels to/from the traveling body.

According to a still further embodiment of the present invention, the engine is disposed at the rear portion of the traveling body and the power transmission mechanism is disposed at the intermediate portion of the traveling body. This construction allows for appropriate layout of the respective components constituting the traveling body according to the particular shapes thereof.

According to a still further embodiment of the present invention, the swivel bearing is disposed at a position lower than the upper ends of at least either the front or rear wheels. This construction allows the swivel base to be disposed at an even lower position, thereby to further lower the center of gravity of the entire wheeled work vehicle.

According to a still further embodiment of the present invention, the implement support unit pivotally supports a swing member of the ground-work implement via a swing shaft, the swing member pivotally supports a boom via a horizontal shaft and a boom cylinder for lifting up/down the boom is disposed rearwardly of the boom. With this construction, when the swivel base is swiveled, it is possible to prevent the ground-work implement from interfering with the traveling body and also to lower the position of the boom of the ground-work implement as much as possible.

According to a still further embodiment of the present invention, a front portion of the swing member projects radially outward from the swivel base and is set at a height which allows passage of the boom and the boom cylinder above the highest position of the traveling body. This construction serves to ensure sufficient free space for the driver on the swivel base and to allow the full-angle swiveling movement of the ground-work implement.

According to a still further embodiment of the present invention, a driver's seat mounting frame disposed on the swivel base includes a rear upward projecting portion projecting rearward and upward from the swivel base and the driver's seat and a ground-work implement manipulating unit are disposed on said rear upward projecting portion thereby to allow the driver's seat to pass above the traveling body when the swivel base is swiveled. This construction too serves to ensure sufficient free space for the driver on the swivel base and to allow the full-angle swiveling movement of the ground-work implement.

According to a still further embodiment of the present invention, each of the driver's seat mounting frame and the implement support unit mounted on the swivel base includes a pair of right and left front and rear attaching portions, to which front and rear ends of a ROPS (roll-over protection system) having a substantially angular hooked shape are connected. This greatly facilitates attachment of the ROPS.

Further and other features and advantages of the present invention will become apparent upon reading the following detailed description of preferred embodiments thereof in conjunction with accompanying drawings.

DESCRIPTION OF THE PREFERRED EMBODIMENTS

Figure 1:
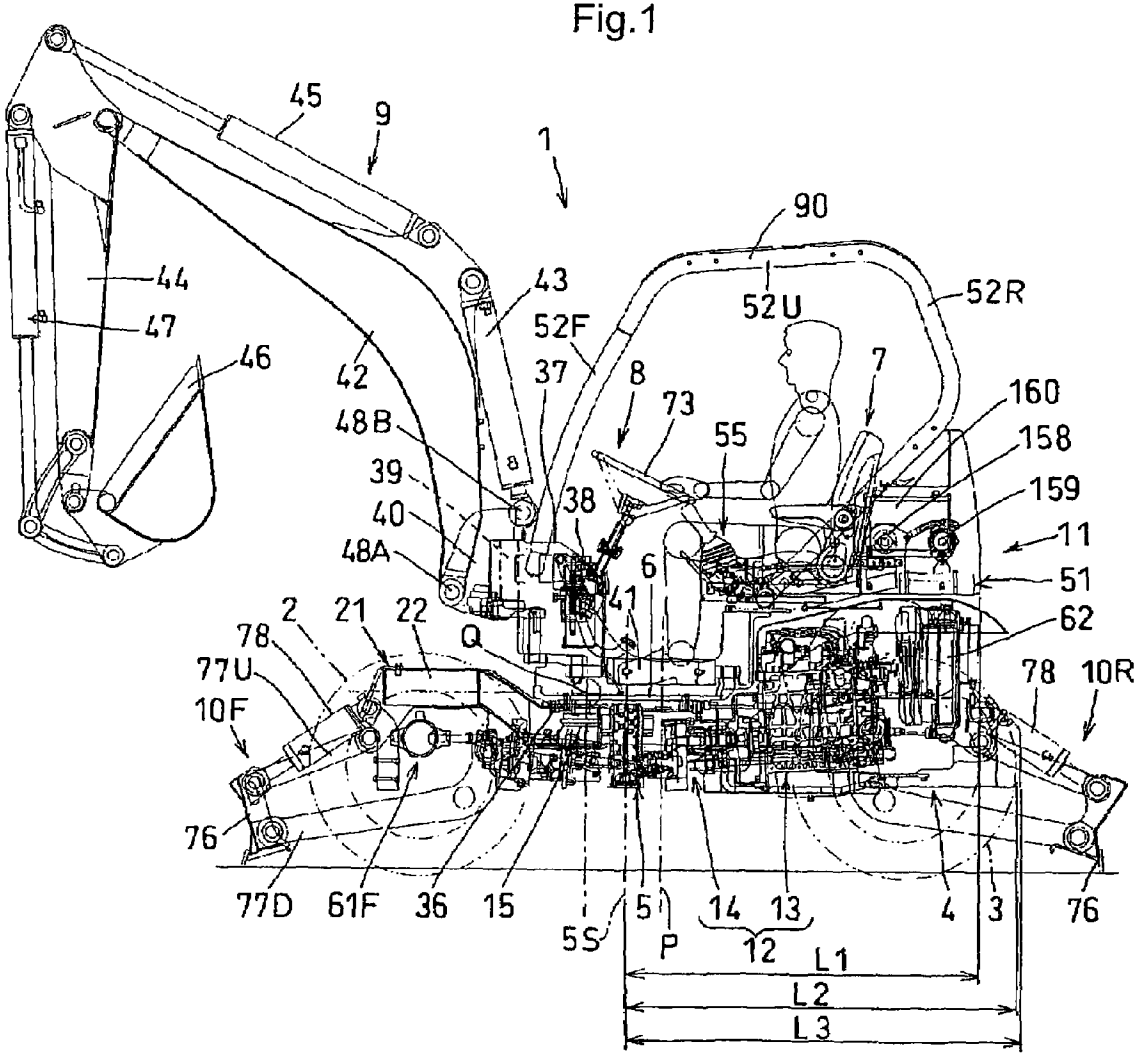
FIG. 1 is a side view partially in section showing an embodiment of the invention in its entirety.

Embodiments of the invention will be described with reference to the accompanying drawings.

Referring to FIGS. 1 through 7, a wheeled work vehicle 1 includes, as its major components, a 4-wheeled type traveling body 4 having front and rear wheels 2, 3, an upper structure 11 having a swivel base 6 mounted on the traveling body 4 via a swivel shaft (swivel axis) 5 and having also a driver's seat 7 and a steering unit 8 both mounted on the base 6, a ground-work implement 9 mounted on the swivel base 6, and front and rear dozers (acting also as stabilizers) 10F, 10R attached to front and rear portions of the traveling body 4.

The traveling body 4 includes a traveling drive unit 12 having an engine 13 and a power transmission mechanism 14, a vehicle frame 21, front wheel suspension units 61F suspending the front wheels 2 therefrom, rear wheel suspension units 61R suspending the rear wheels 3 therefrom, and so on. The traveling body 4 mounts the engine 13 at a rear portion thereof and mounts selector valves 54 for hydraulic system at a front portion thereof. In the upper structure 11, the steering unit 8 is disposed forwardly of the driver's seat 7.

As shown in FIGS. 2, 4, 5, 8–10, the vehicle frame 21, which presents a ladder-like shape in a plan view, includes a pair of right and left side frames 22 formed of angular pipes, front and rear plate-like frames 23F, 23R interconnecting front and rear portions of the opposed side frames 22, a bearing support member 25 to which a swivel bearing 36 is attached, the bearing support member 25 interconnecting intermediate portions of the opposed side frames and a plurality of other connecting members for connecting the front and rear portions of the opposed side frames. Further, the right and left side frames 22 mounts, at their intermediate to rear portions thereof, the engine 13 and the power transmission mechanism 14 and mounts also a radiator 62 at rear portions thereof. The power transmission mechanism 14 is attached to the engine 13 and/or the right and left side frames 22.

Figure 10:
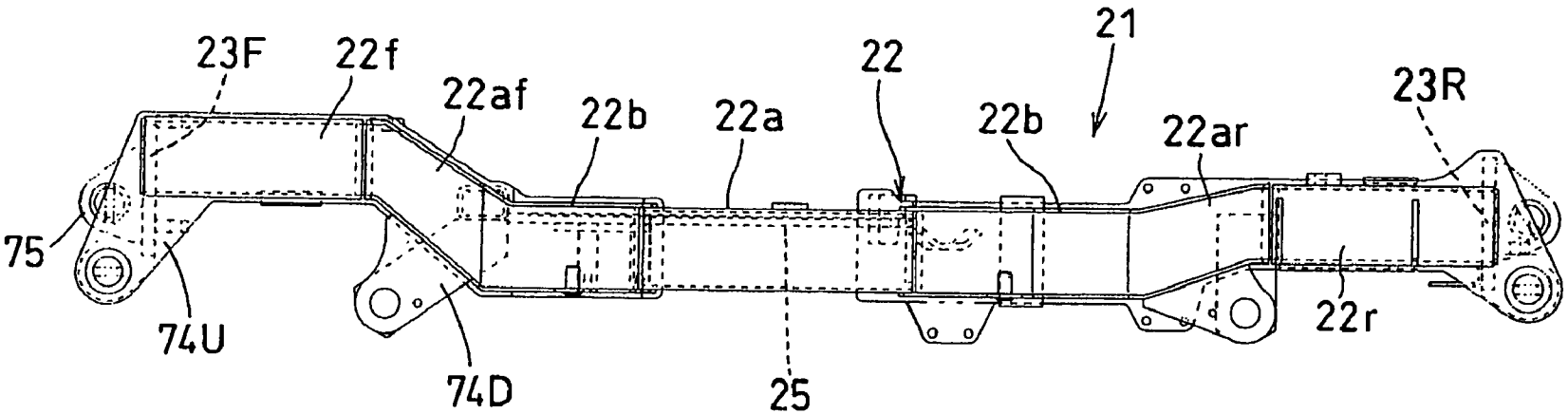
FIG. 10 is a side view of the vehicle frame

Here, according to essential features of the present invention, as may be apparent from FIG. 1 and FIG. 10, the vehicle frame 21 include an intermediate frame portion located between the front and rear wheels 2, 3 and supporting the swivel bearing 36 and front and rear frame portions each located at a ground level higher than the intermediate frame portion. The front frame portion mounts the front wheel suspension units 61F for the front wheels 2 whereas the rear frame portion mounts the rear wheel suspension units 61R for the rear wheels 3. To this end, as may be apparent from FIG. 9 and FIG. 10, the vehicle frame 21 includes right and left side frames 22, a front frame 23F acting as a cross beam for interconnecting the right and left side frames 22 at front portions thereof with a predetermined distance therebetween and a rear frame 23R acting as a further cross beam for interconnecting the right and left side frames 22 at rear portions thereof with a predetermined distance therebetween. Further, each of the two side frames 22 includes an a horizontal intermediate portion 22*a* located at an intermediate portion of the side frame, a horizontal rear portion 22*r* located at a rear portion of the side frame and having a higher ground level than the intermediate portion 22*a*, a horizontal front portion 22*f* located at a front portion of the side frame and having a higher ground level than the intermediate portion 22, a rear transition portion 22*ar* connecting a rear end of the intermediate portion 22 and the rear portion 22*r*, and a front transition portion 22*af* connecting a front end of the intermediate portion 22 and the front portion 22*f*. Further, a distance between the right and left intermediate portions 22*a* is greater than a distance between the opposed front portions 22*f* and greater also than a distance between the opposed rear portions 22*r*. Further, the front portions 22*f* have a higher ground level than the rear portions 22*r*.

Namely, in the side view of the vehicle frame 21, in each of the right and left side frames 22, the intermediate portion 22*a* is disposed downwardly of the swivel base 6 is located at the lowermost level, the rear portion 22*r* raised in the fore/aft direction from this intermediate portion 22*a* is located at a higher level and the front portion 22*f* raised also from the intermediate portion 22*a* is located at an even higher level, so that the vehicle frame 21 allows attachment of the front and rear wheel suspension units under the front and rear portions thereof, respectively.

More particularly, the top face of the intermediate portion 22*a* which is overlapped with the swivel base 6 mounted on the vehicle frame 21 is set lower than the top faces of the front and rear portions and the bottom faces of the front and rear portions are set higher than the bottom face of the intermediate portion 22*a*. With these arrangements, compared with a conventional vehicle frame which is formed flat entirely, the swivel base 6 can be disposed at a lower level, thus reducing a ground-level difference between the swivel base 6 and the front and rear suspension units 61F, 61R, whereby the center of gravity of the vehicle is lowered advantageously.

Further, in the plan view of the vehicle frame 21, in the right and left side frames 22, the opposed intermediate portions 22*a* overlapped with the swivel base 6 are formed wider in the right/left direction than the opposed front portions and also the opposed rear portions. In addition, each side frame 22 is bent at two positions in the fore/aft direction and then extends outward therefrom, so that the side frame presents a trapezoidal shape.

In the right and left side frames 22, the opposed intermediate portions 22*a* form the distance, i.e. right/left-wise width, greater than that of the front portions and that of the rear portions as described above. And, to top and bottom faces of border portions between the intermediate portion 22*a* and the front and rear portions, there are attached reinforcing plates 22*b*.

In the ladder-like shaped vehicle frame 21 described above, the intermediate portions 22*a* extend outward in the right/left directions from the front and rear portions and also the right and left sides of the frame are located radially inside the outer periphery of the swivel base 6 and also radially outside the outer periphery of the swivel bearing 36. So that, the swivel bearing 36 is confined within and vertically overlapped with the area delimited between the opposed intermediate portions 22*a* of the vehicle frame 21, thereby to allow for the lower-level mounting of the swivel base 6.

The vehicle frame 21 thus constructed provides a rigid and strong structure capable of sufficiently supporting the upper load as well as withstanding load in the fore/aft direction. And, as the intermediate portions 22*a* are formed lower than the front and rear portions, the swivel bearing 36 and the swivel base 6 can be disposed at lower positions than the upper ends of the front and rear wheels 2, 3.

Figure 2:
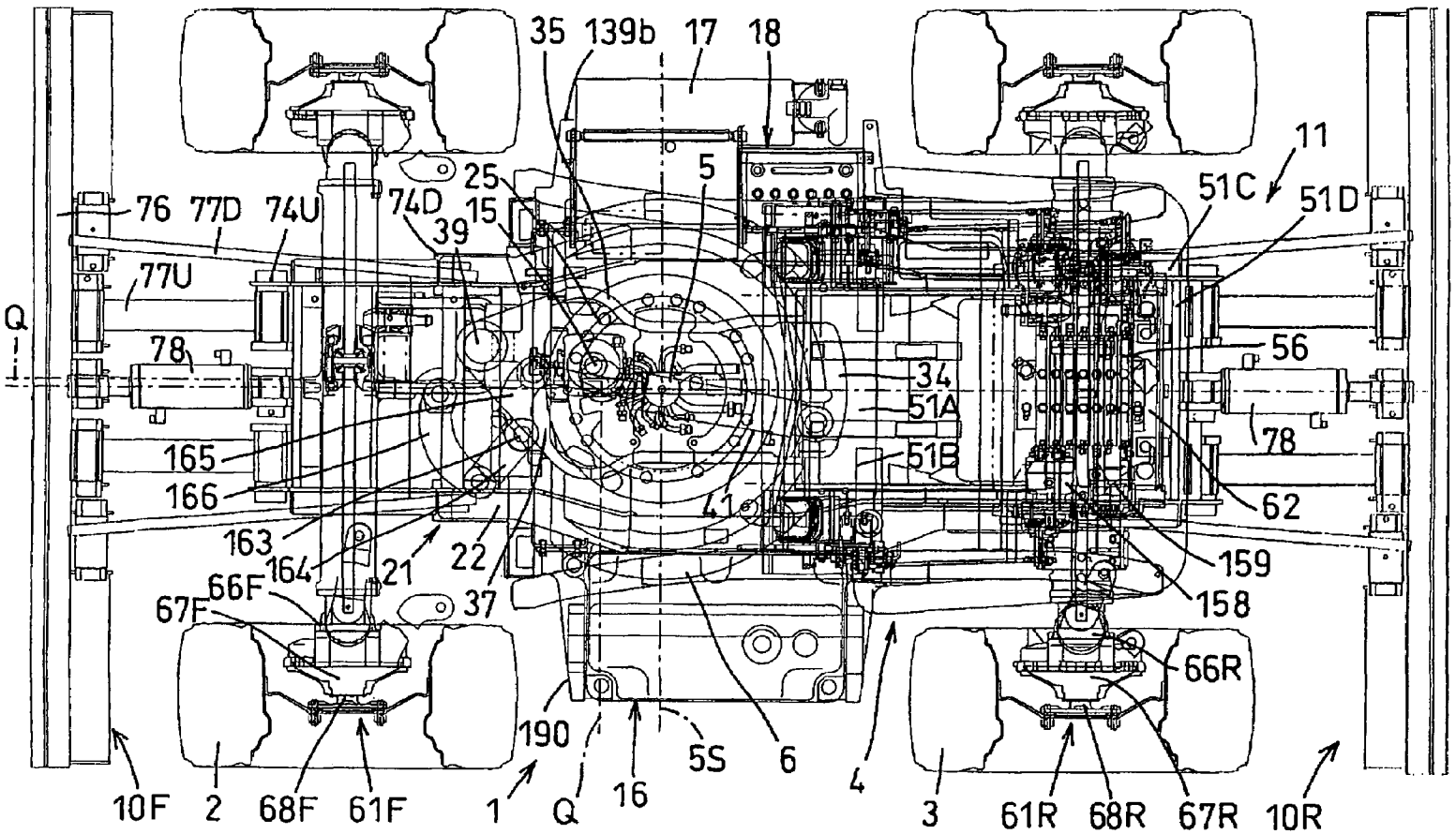
FIG. 2 is a plan view partially in section showing the embodiment.
Figure 3:
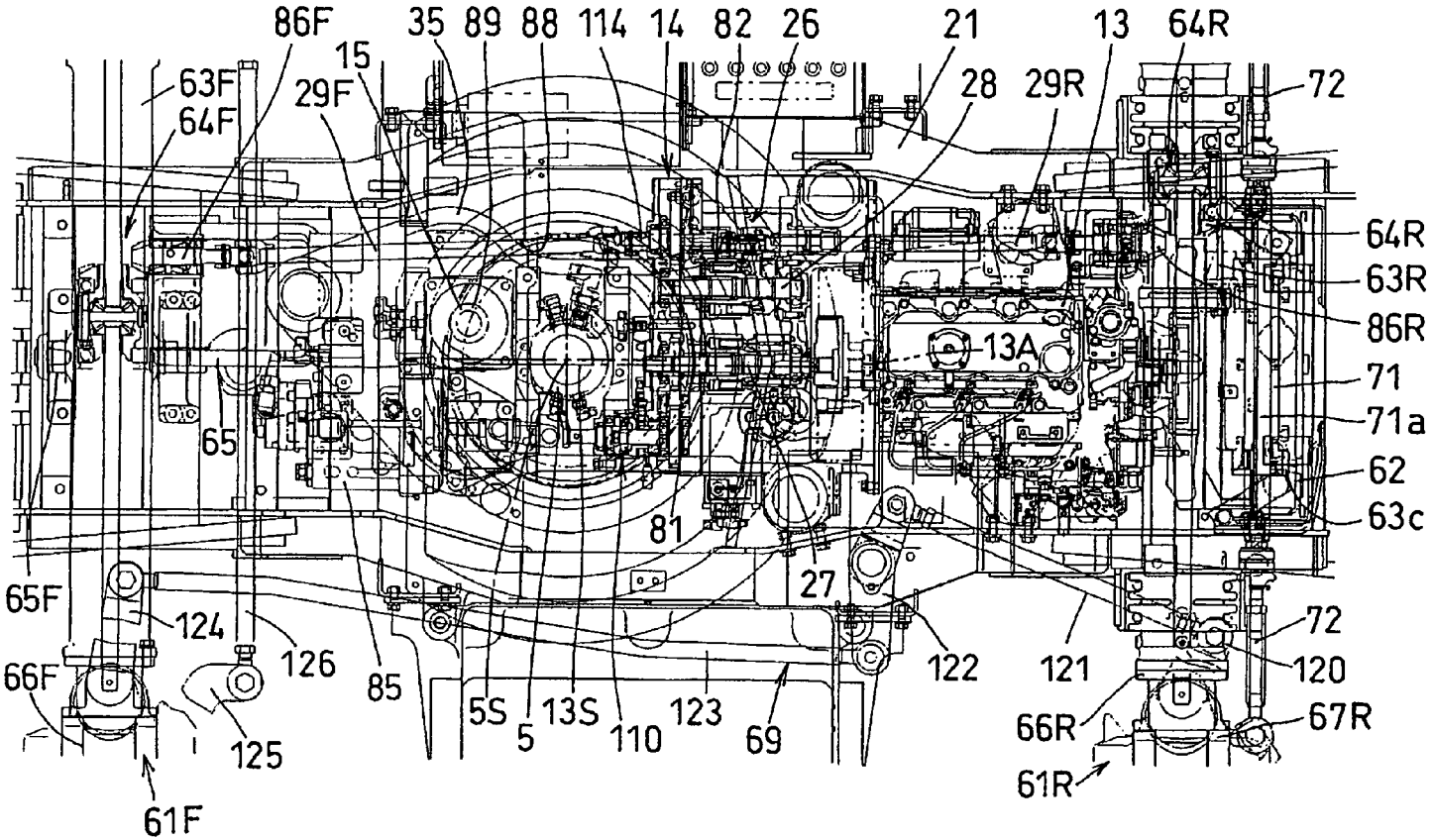
FIG. 3 is a plan view partially in section showing a center portion of the embodiment.
Figure 4:
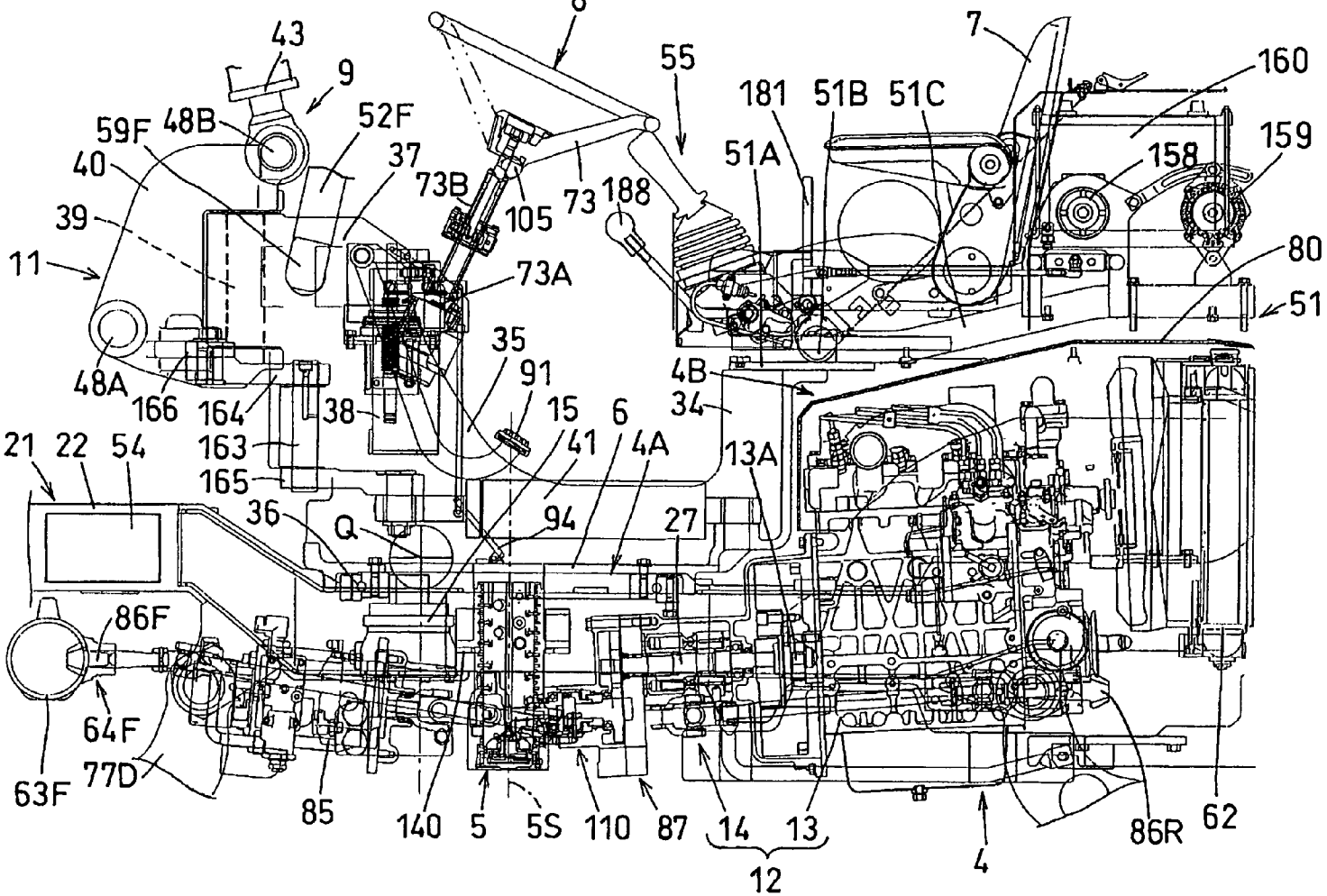
FIG. 4 is a side view partially in section showing the center portion
Figure 5:
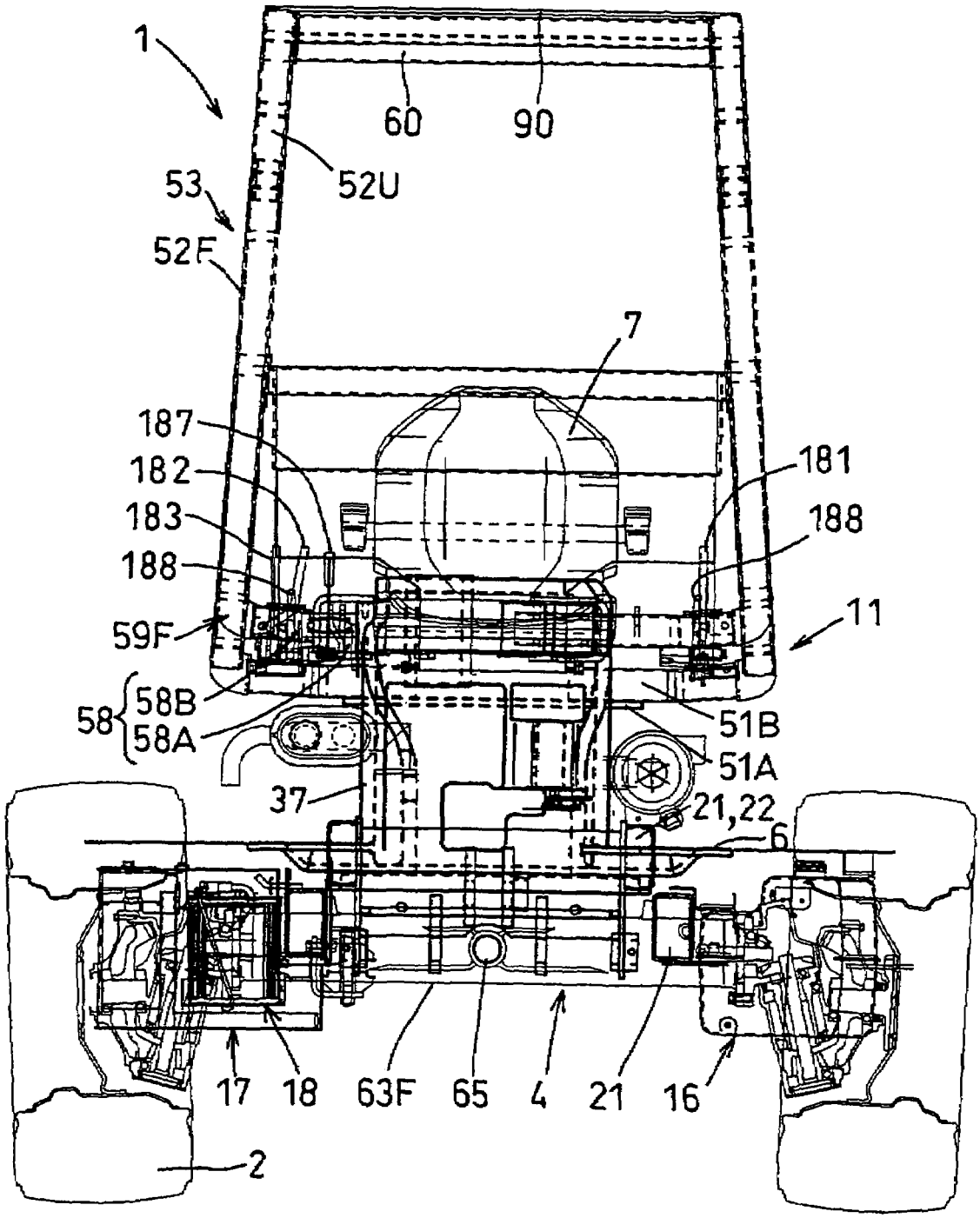
FIG. 5 is a front view partially in section showing the embodiment.
Figure 6:
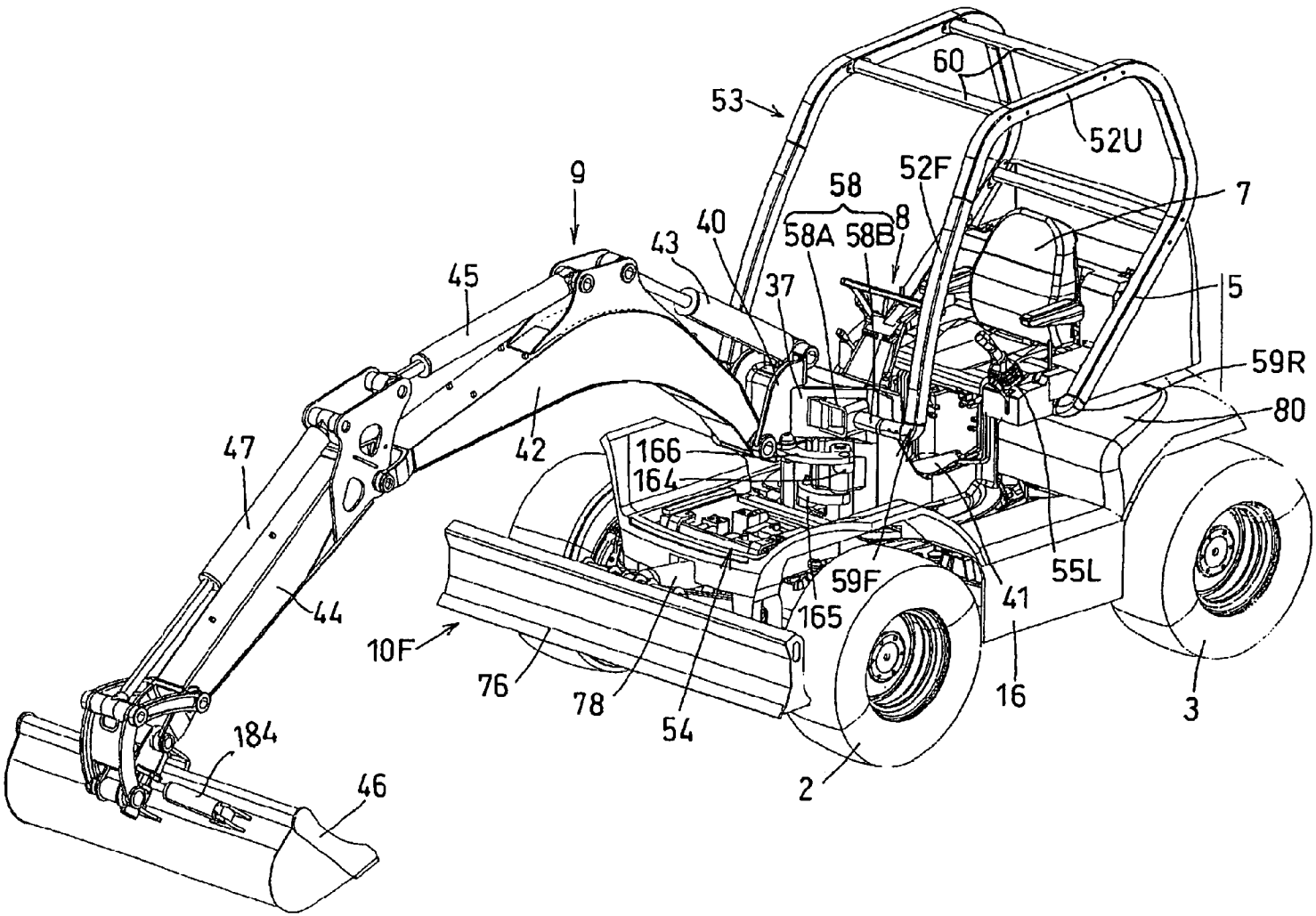
FIG. 6 is an overall front perspective view.
Figure 7:
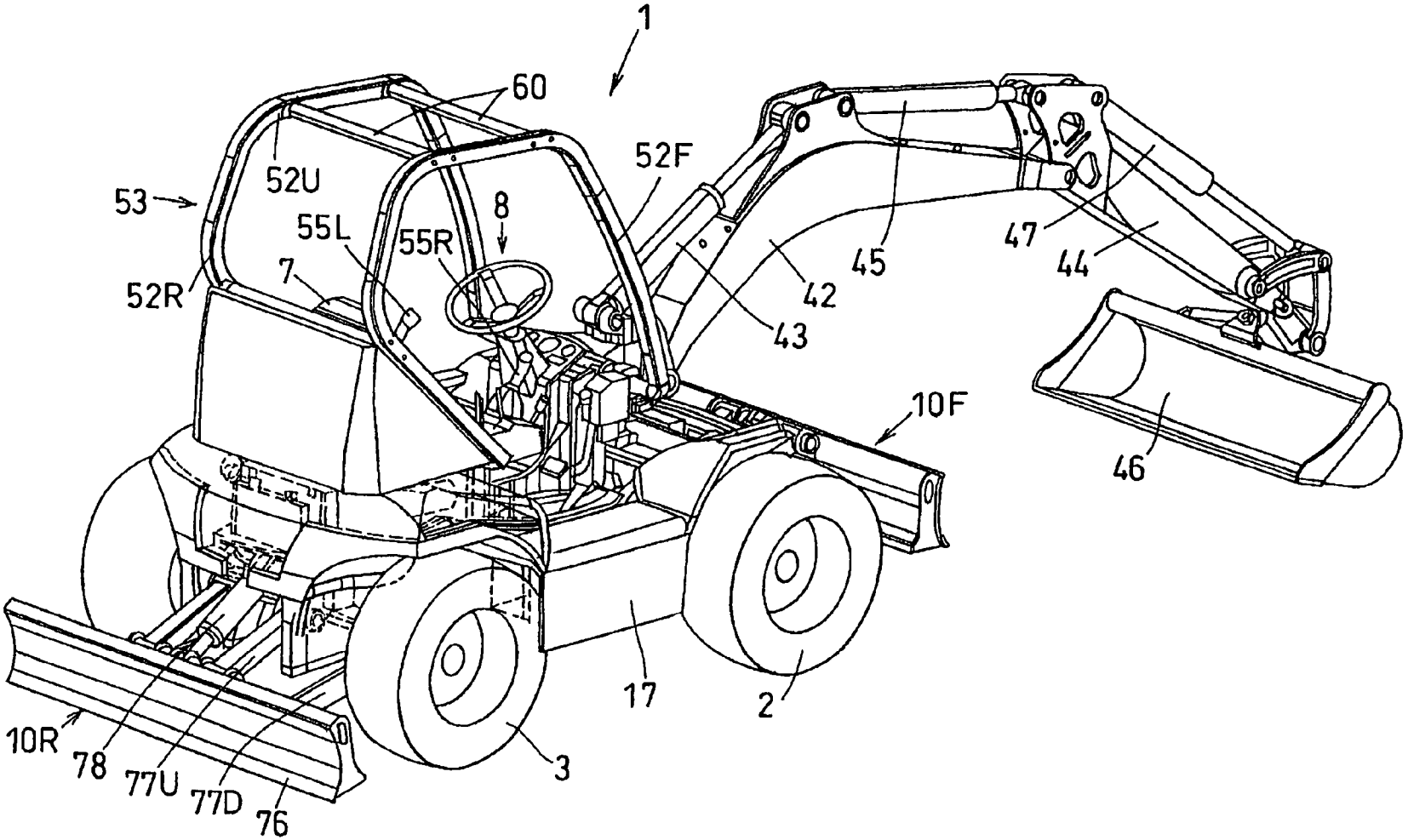
FIG. 7 is an overall rear perspective view.

As may be seen from FIGS. 2 and 3, each front wheel suspension unit 61F includes a cylindrical hollow front axle case (differential case) 63F and a front wheel differential unit 64F accommodated therein. The right-to-left center of this front axle case 63F is supported to the front lower portion of the vehicle frame 21 via a center pin 65F extending in the fore-and-aft direction, thereby to allow the right and left ends of the unit to be vertically pivotable. Further, at a right or left end of the front axle case 63F, there is provided a bevel gear case 66F for supporting a king pin, and to this bevel gear case 66F, there is provided a front wheel transmission case 67F to be pivotable about the king pin, and the front wheel 2 is mounted on an axle 68F supported to this front wheel transmission case 67F. With this, the right and left front wheels 2 are steerable via the respective front wheel transmission cases 67F by a steering means 69.

Figure 11:
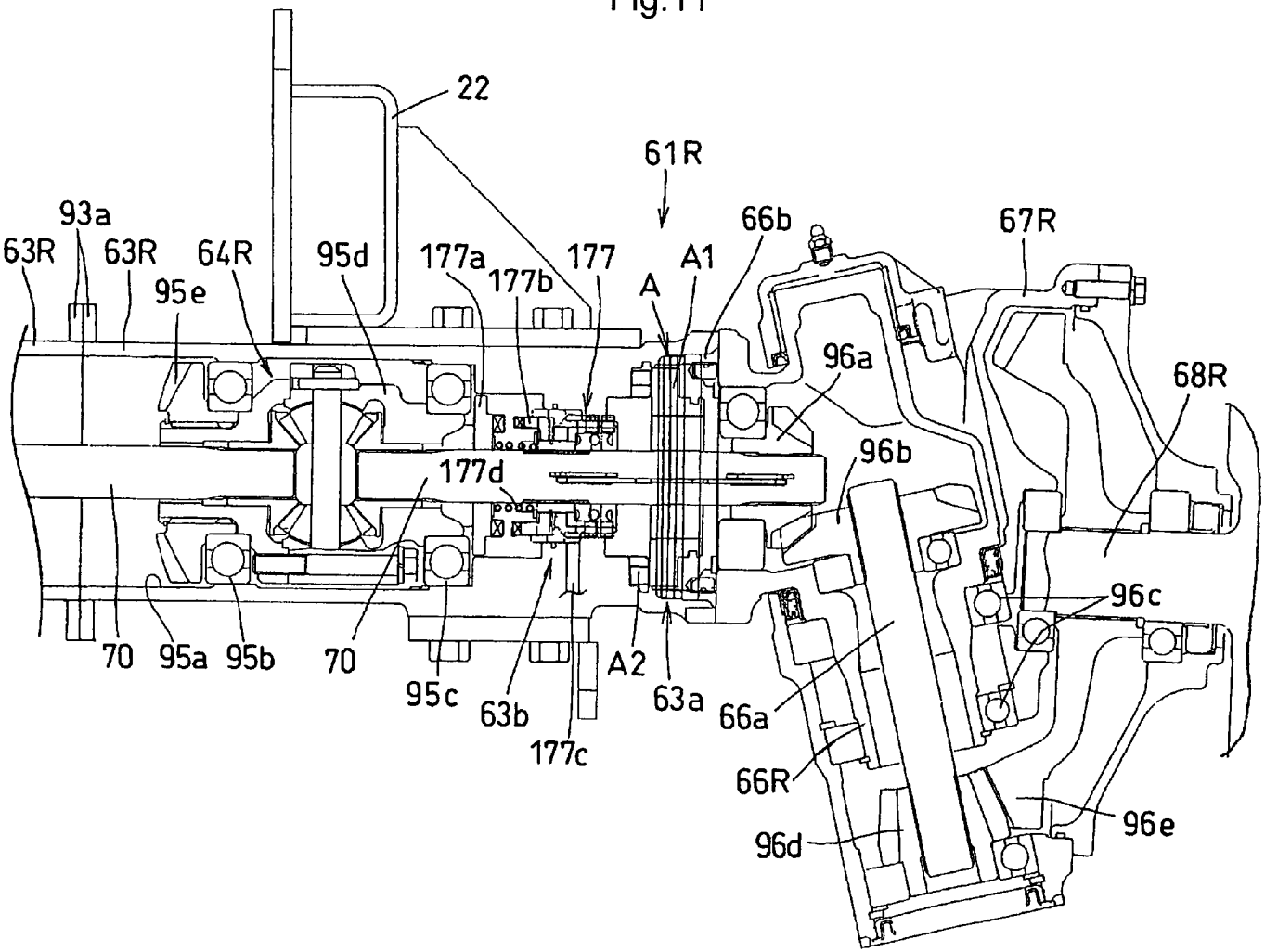
FIG. 11 is a rear view in section of a rear suspension unit.
Figure 12:
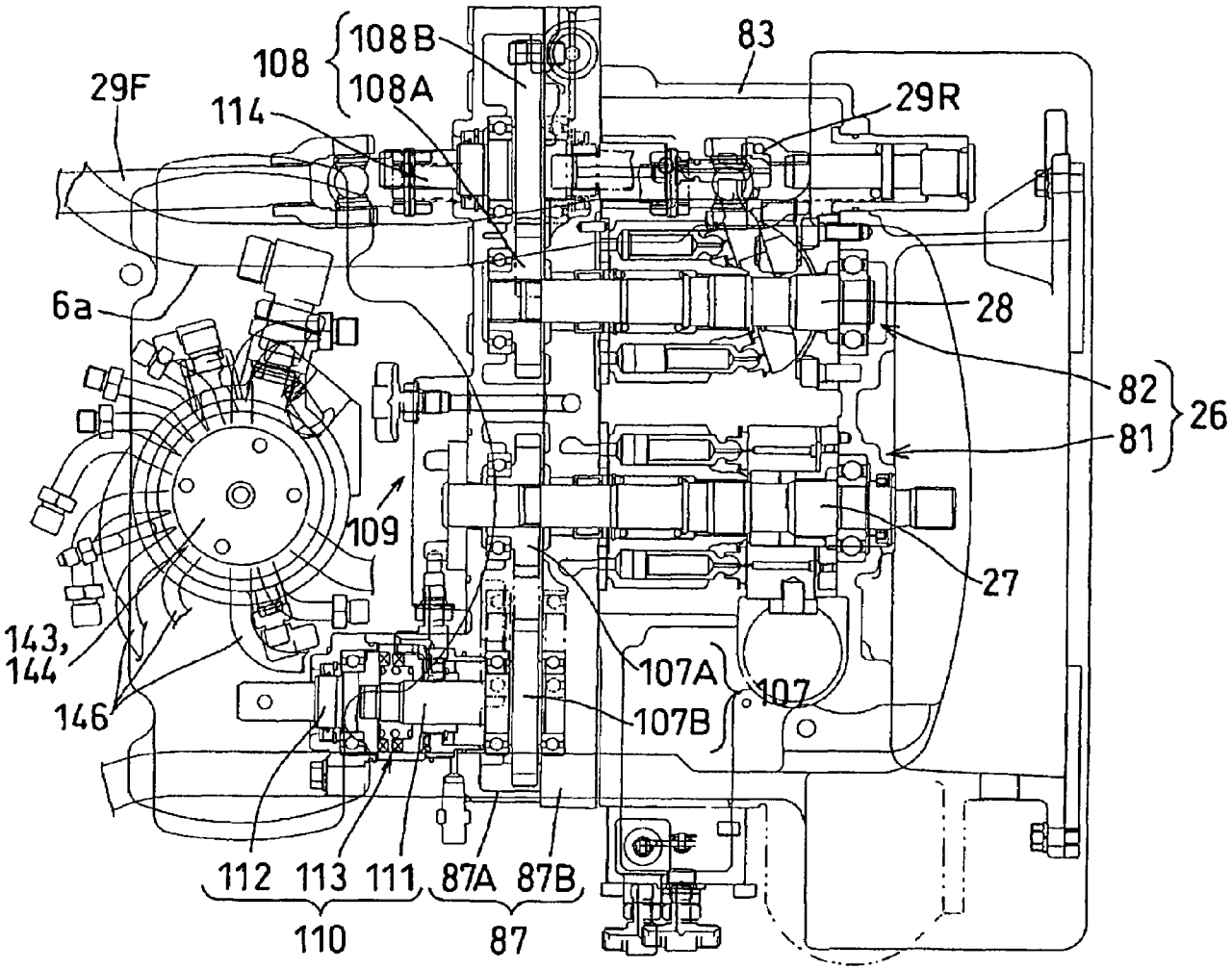
FIG. 12 is a plan view in section of a transmission.
Figure 13:
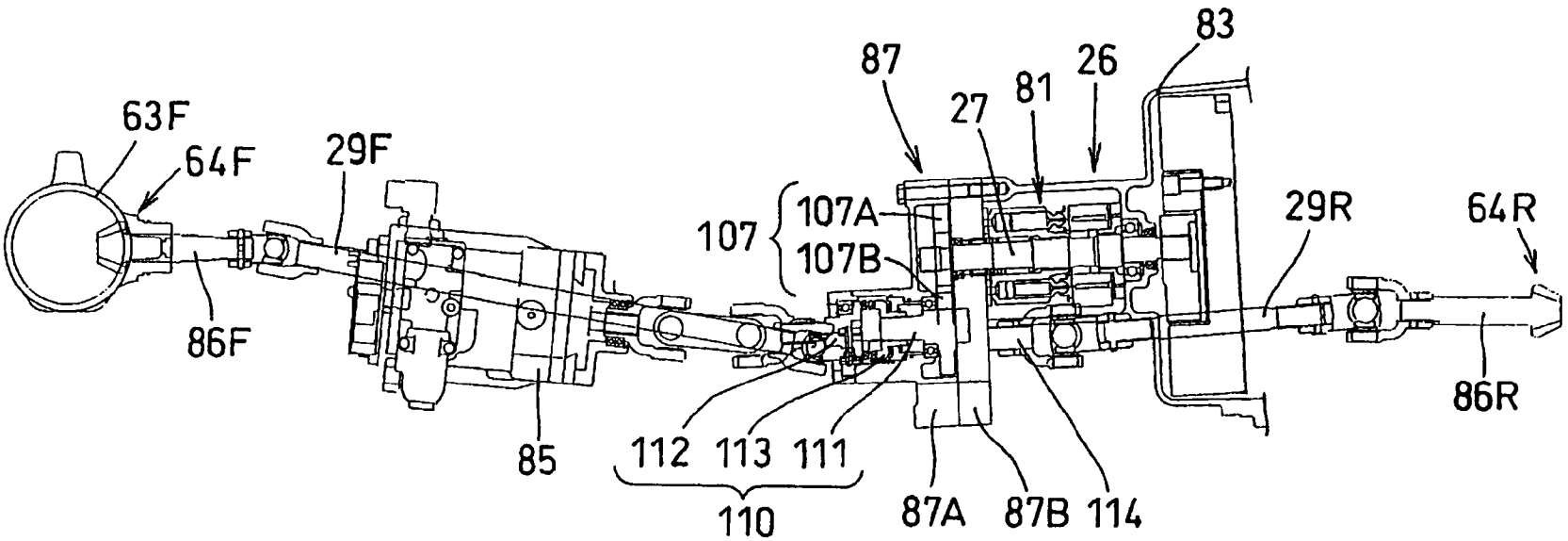
FIG. 13 is a side view in section showing a traveling transmission system.
Figure 14:
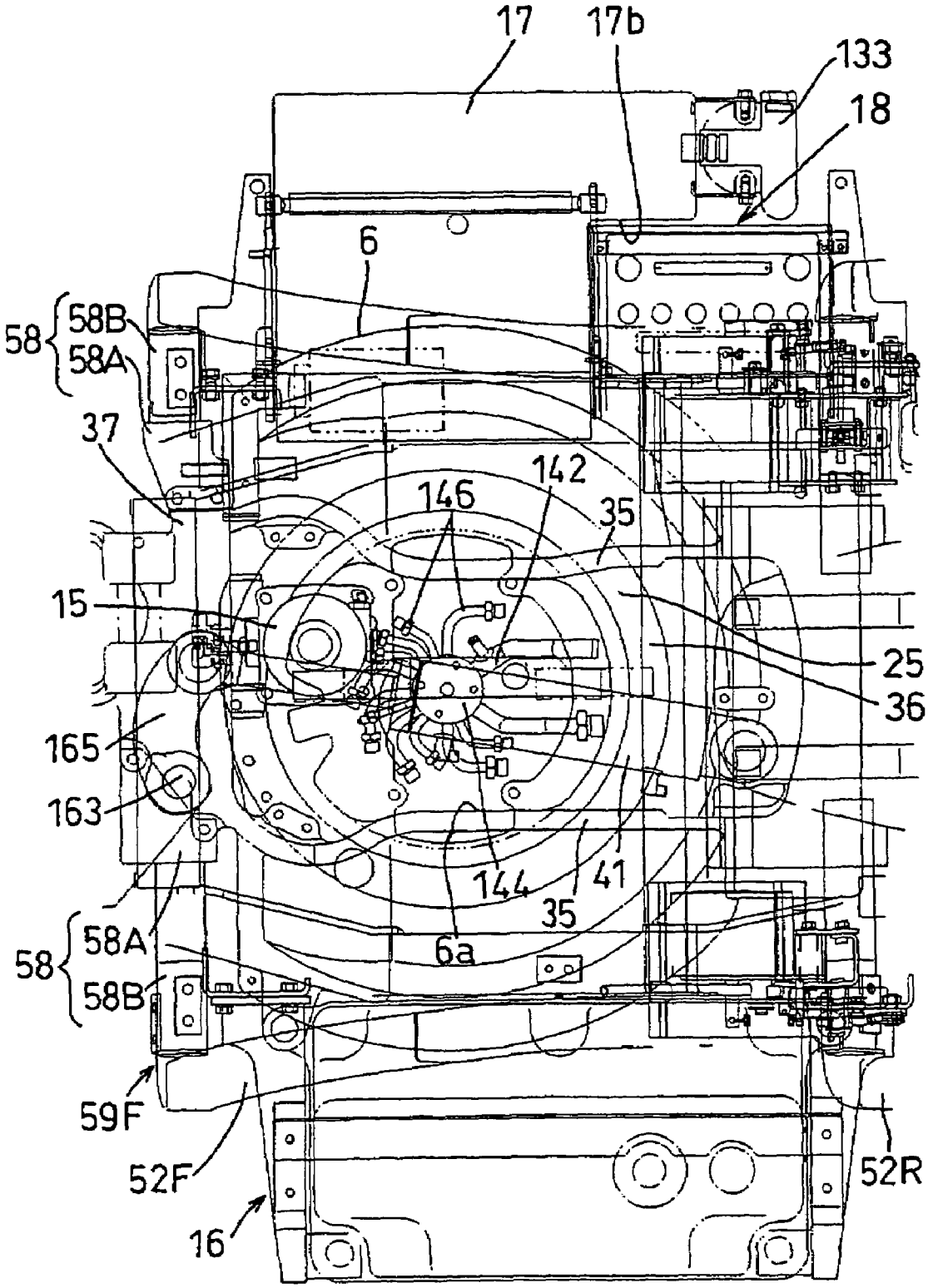
FIG. 14 is a plan view showing a center portion of a traveling body.
Figure 15:
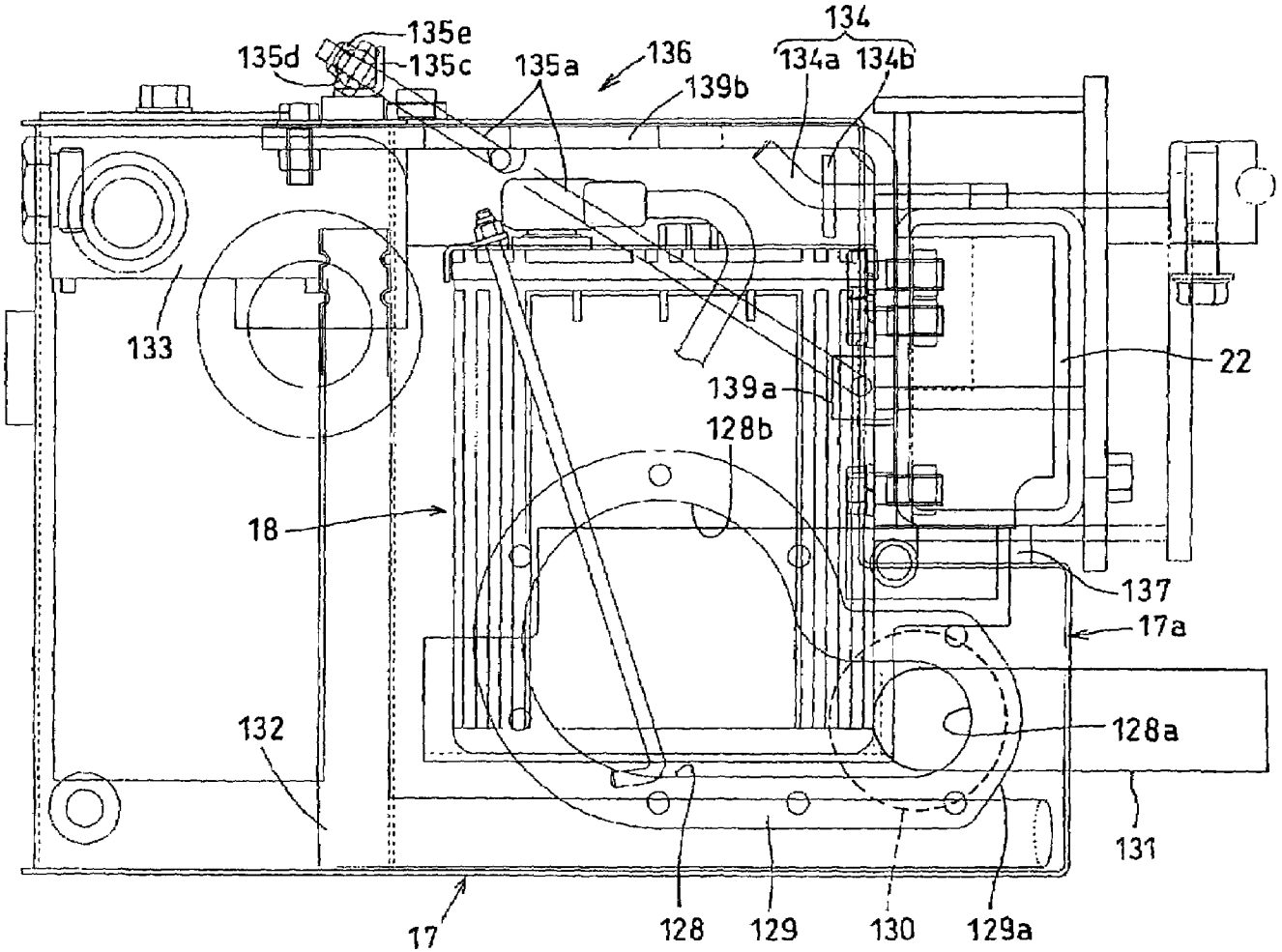
FIG. 15 is a front view of a work oil tank.
Figure 16:
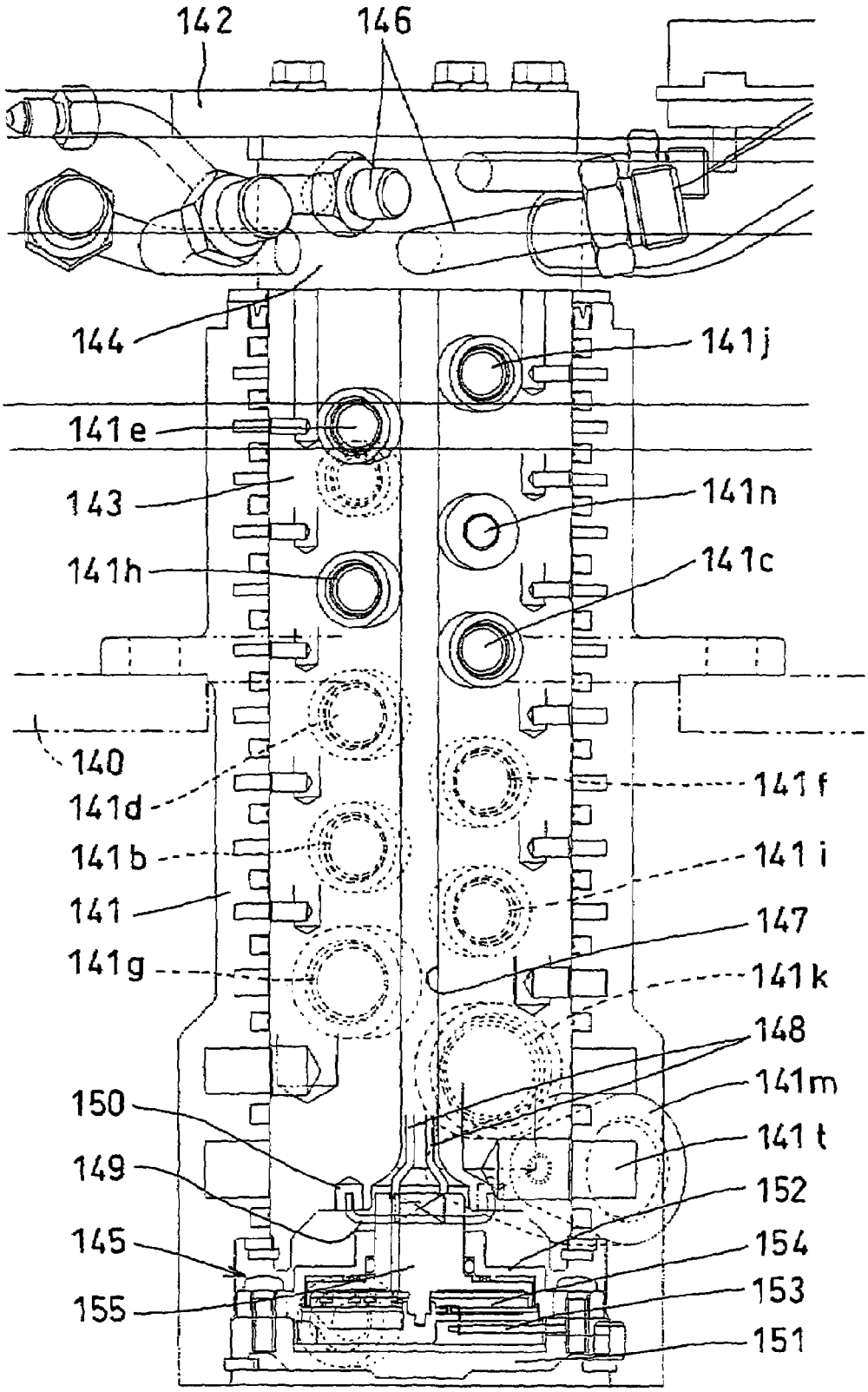
FIG. 16 is a section view showing a swivel joint in its entirety.
Figure 17:
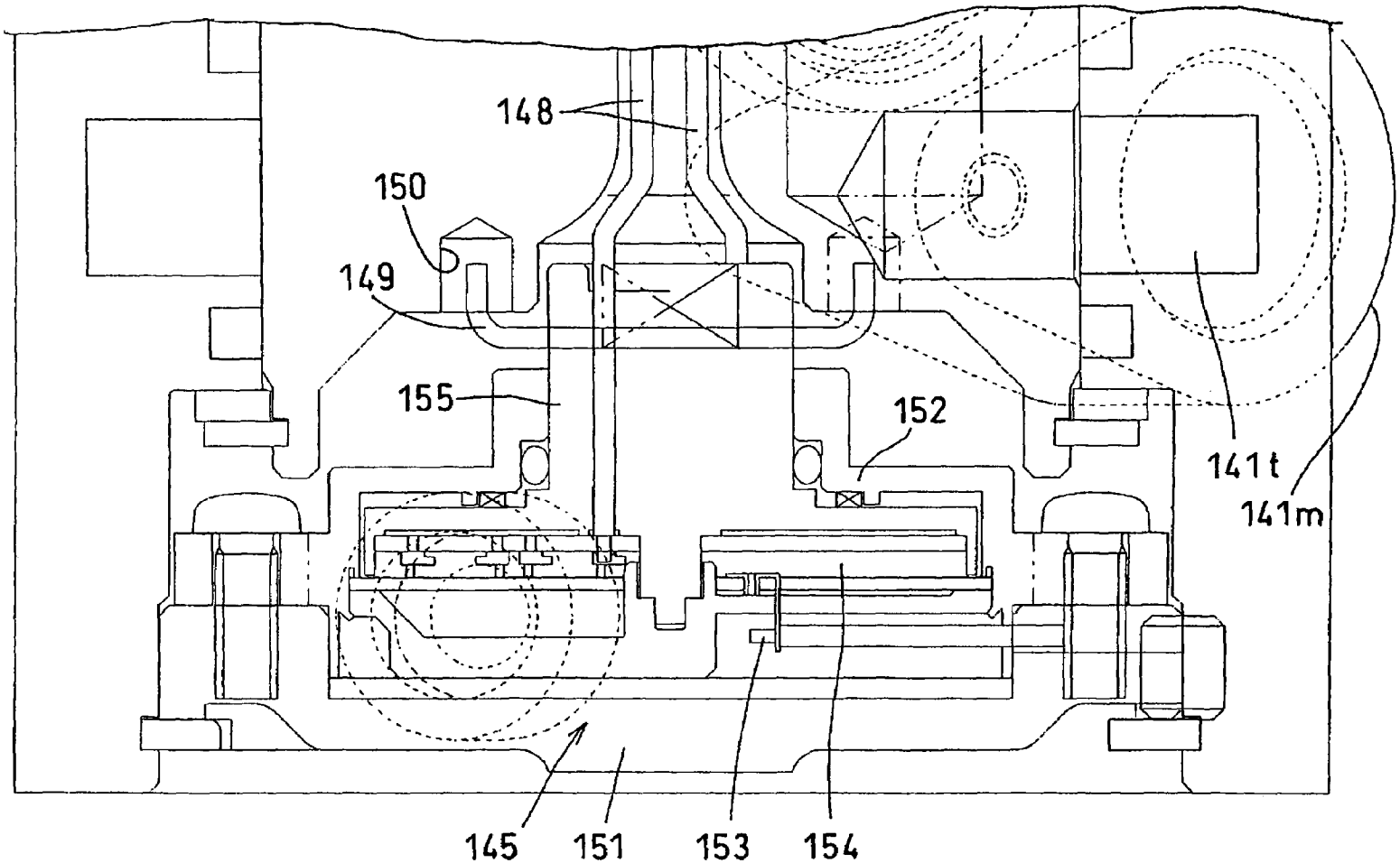
FIG. 17 is a section view showing a lower portion of the swivel joint.

Like the front wheel suspension unit 61F described above, as shown in FIGS. 3 and 11, each rear wheel suspension unit 61R includes a cylindrical hollow rear axle case 63R and a rear wheel differential unit 64R accommodated therein. To the right or left end of the rear axle case 63R, there is provided a bevel gear case 66R supporting a king pin 66*a*. This bevel gear case 66R includes a rear wheel transmission case 67R to be pivotable about the king pin 66*a* and the rear wheel 3 is mounted on an axle 68R supported to this rear wheel transmission case 67R. With this, the right and left rear wheels 3 are steerable via the respective rear wheel transmission cases 67R by the rear steering means 69.

Like the front wheel suspension unit 61F, the rear wheel suspension unit 61R also may be constructed such that the right-to-left center of the rear axle case 63R is supported for allowing, via a center pin provided at a rear lower portion of the vehicle frame 21 extending in the fore-and-aft direction, the right and left ends of the unit to be vertically pivotable. In this embodiment, however, the rear axle case 63R is fixed to the vehicle frame 21.

Referring to the rear wheel suspension unit 61R, the rear axle case 63R comprises right and left separate members which are coupled via a flange portion 93*a* in abutment with each other. One separate member accommodates therein a rear wheel differential unit 64R inserted from the end therefor where the flange portion 93*a* is formed and supports a bevel pinion shaft 86R inserted therein for receiving power from the power transmission mechanism 14.

In one rear axle case 63R, a pair of bearings 95B, 95*c* are supported within a cylindrical hole 95*a*. These bearings 95*b*, 95*c* support a differential case 95*d*. This differential case 95*d* mounts at an end thereof a differential large gear 95*e* meshing with the bevel pinion shaft 86R. This differential large gear 95*e* is supported by the one bearing 95*b* also. From the differential case 95*d*, a differential yoke shaft 70 extends outwards to the right and to the left.

Each of the right and left rear axle cases 63R includes, at outer ends thereof, brake portions 63*a* and a differential lock portion 63*b* formed more inward than the brake portions 63*a*. At an outer end of each of the right and left brake portions 63*a*, the bevel gear case 66R is secured and to this bevel gear case 66R, there is attached the rear wheel transmission case 67R supporting the rear wheel 3 via the axle 68R.

The differential yoke shaft 70 extends through from the rear wheel differential unit 64R into the right and left bevel gear cases 66R. Between this differential yoke shaft 70 and the brake portions 63*a*, there is disposed a hydraulic brake mechanism A and between the differential yoke shaft 70 and the differential lock portion 63*b*, there is disposed a hydraulic differential lock mechanism 177.

The bevel gear case 66R is connected to the outer end of the brake portion 63*a* through a faucet-like joint and supports via a bearing a bevel gear 96*a* fitted on the outer end of the differential yoke shaft 70 and supports also a bevel gear 96*b* fitted on the upper end of the king pin 66*a* and meshed with the bevel gear 96*a*.

The rear wheel transmission case 67R is supported to a lower potion of the bevel gear case 66R via a pair of bearings 96*c* to be pivotable about the king pin 66*a* and its upper portion too is pivotally supported to an upper portion of the bevel gear case 66R.

This rear wheel transmission case 67R supports the axle 68R and supports also the bevel gear 96*d* fitted on a lower portion of the king pin 66*a* for meshing with the bevel gear 96*e* fitted on the axle 68R.

The bevel gear case 66R and the rear wheel transmission case 67R together constitute a final reduction case mounted on the outer end of each of the right and left rear axle cases 63R and the two sets of bevel gears 96*a*, 96*b*, 96*d*, 96*e* accommodated therein together constitute a final reduction mechanism.

The brake portion 63*a* houses therein a piston A2 for pushing a disc A1 of the brake mechanism A into an engaging portion 66*b* of the bevel gear case 66R. In operation, as the piston A2 is pushed by an oil pressure externally supplied, the disc A1 is pushed into the engaging portion 66*b* of the bevel gear case 66, thereby to brake the differential yoke shaft 70. Incidentally, the disc A1 may be directly pushed into the engaging portion 66*b* of the bevel gear case 66R. But, an abutment plate may be provided or the piston A2 may be disposed on the side of the engaging portion 66*b* so that the disc A1 is pushed toward the rear axle case 63R.

The differential lock mechanism 177 includes an engaging member 177*a* fixed to the differential case 95*d*, a movable engaging member 177*b* provided on the differential yoke shaft 70 to be rotatable therewith and movable relative thereto, a hydraulic means 177*c* for pushing the movable engaging member 177*b* toward the engaging member 177*a* for engagement therewith and an urging means 177*d* for urging the movable engaging member 177*b* away from the engaging member 177*a*. Hence, upon engagement between the movable engaging member 177*b* and the engaging member 177*a*, the differential case 95*d* and the differential yoke shaft 70 are rotated in unison.

As the differential lock mechanism 177 has a relatively small outer diameter, the differential lock portion 63*b* of the rear axle case 63R projects radially inward and is smaller than the cylindrical hole 96*b*. For this reason, the rear wheel differential unit 64R and the brake mechanism A can be fixed in position in one direction.

The other separate member does not support the rear wheel differential unit 64R or the bevel pinion shaft 86R. However, the brake mechanism A of the brake portion 63*a* and the differential lock mechanism 177 of the differential lock portion 63*b* of the other separate member are substantially same as those of the one separate member described above.

As shown in FIG. 3, the right and left rear axle cases 63R include cylinder attaching portions 63*a* projecting in opposition to each other and a hydraulic steering cylinder 71 of the steering means 69 is attached to these cylinder attaching portions 63*c*. The connection between the right and left rear axle cases 63R functions also as the attachment of the cylinder 71.

The steering means 69 includes the hydraulic cylinder (power steering cylinder) 71 provided in the rear axle case 63R and a tie rod 72 interconnecting opposed ends of a piston rod 71*a* of the hydraulic cylinder 71 and the right and left rear wheel transmission cases 67R, so that with a movement of the piston rod 71*a* to the right or left the steering means 69 pivots the right and left rear wheel transmission cases 67 about the king pin 66*a*, thereby to steer the rear wheels 3.

To the left rear wheel transmission case 67R, there is fixed an arm 120 and a first coupling rod 121 is connected to this arm 120. Numeral 122 denotes a moving body having an intermediate portion thereof pivotally supported via a vertical shaft to the intermediate portion 22*a* of the left side frame 22. To opposed ends of this moving body 122, there are connected one end of the first coupling rod 121 and one end of a second coupling rod 123, respectively. The other end of the second coupling rod 123 is connected to an arm 124 provided in the left front wheel transmission case 67F for the front wheel 2. Knuckle arms 125 of the right and left front wheel transmission cases 67F are interconnected via a tie rod 126.

With the steering means 69 in operation, when the rear wheels 3 are steered by the actuation of the hydraulic cylinder 71, the front wheels 2 are also steered through the moving body 122 and the first and second coupling rods 121, 123. In this, the front wheels 2 and the rear wheels 3 are steered in opposite directions. Instead, the front and rear wheels 2, 3 may be steered in a same direction.

The traveling body 4 is a two-shaft, four-wheel drive construction in which the power is transmitted from the traveling drive unit 12 to both the front wheel differential unit 64F and the rear wheel differential unit 64R and is also a four-wheel steering type construction in which the front and rear wheels 2, 3 are steerable in opposite directions (or may be in a same direction) via the front and rear steering means 69F, 69R in response to a steering operation by a single steering wheel 73.

However, the traveling body 4 may alternatively be constructed such that either the front wheels 2 or the rear wheels 3 alone are provided as the drive and steerable wheels with the other as driven and non-steerable, i.e. straight traveling, wheels. Further alternatively, the structure may be constructed such that either the front wheels 2 or the rear wheels 3 alone are constantly driven and steered and the other are driven and steered only when needed.

Further, in the illustrated embodiment, the front and rear wheels 2 and 3 have substantially same diameter. Instead, one of them may have a greater or different diameter than the other.

As shown in FIGS. 1, 2, 6 and 7, at the front and rear portions (front and rear frames 23F, 23R) of the traveling body 4, in order to mount respective dozers 10F, 10R at each of these portions, a pair of right and left upper arm supports 74U, lower arm supports 74D and a central upper cylinder support 75 project forwardly.

Each dozer 10F, 10R includes a blade 76, a pair of right and left arms 77U attached to an upper portion of the rear face of the blade 76 and pivotally supported to the upper arm supports 74U to be liftable about horizontal axes, and an operational cylinder 78 supported to the cylinder support 75 for lifting the dozer 10 up and down so as to bring the blade 76 into contact with the ground surface or insert it into the ground.

This dozer 10F, 10R has a substantially same construction and substantially same function as a dozer device of a backhoe. However, if the ground-work implement 9 is used mainly for ground excavating work, then, the main function of the dozer is that of a stabilizer for the traveling body 4 (i.e. function as an outrigger). The dozer may be provided only one of the front and rear portions of the traveling body 4. In this embodiment, however, two of them are provided at the front and the rear portions so that the dozers may lift the traveling body 4 up off the ground during a work.

As may be seen from FIGS. 1, 2, 5–8, 14 and 15, on right and left sides (side frames 22) of the traveling body 4 and between the front and rear wheels 2, 3, there is disposed a fuel tank 16 on one side (left side) and there are disposed a work oil tank 17 and a battery 18 behind it on the other side (right side). The right and left arrangement of these tanks, i.e. the fuel tank 16 and the work oil tank 17 may be reversed. In either case, with this right and left distribution of the tanks, the right and left weight balance of the traveling body 4 is improved and also the space between the front and rear wheels 2, 3 is efficiently utilized.

As described above, the fuel tank 16 and the work oil tank 17 plus the battery 18 are arranged in the right and left distribution on the vehicle frame 21. The work oil tank 17 is detachably mounted on the right side frame 22 and has a substantially L-like shape in front view and includes an extension portion 17*a* extending under the right side frame 22. Within this extension portion 17*a*, an oil filter 130 is disposed and there is formed an L-shaped (in plan view) recess 17*b* for disposing the battery 18.

The recess 17*b* is formed at a rear and right-to-left wise inner portion of the work oil tank 17. Then, as the battery 18 is disposed therein, the battery 18 is covered by the work oil tank 17 from the outer side and the front side.

At a front lower portion of the work oil tank 17, there is formed a keyhole-shaped opening 128 comprising large and small holes 128*a*, 128*b* connected in series. A cover member 129 for closing this opening 128 too has a keyhole-like shape This cover member 129 defines a small-hole corresponding portion 129*a* to which the oil filter (suction filter) 130 and a suction pipe 131 communicating therewith are connected. The suction pipe 131 extends under the side frame 22 to be connected with various valves.

The oil filter 130 as being attached to the cover member 129 is inserted from the large hole 128*b* to the small hole 128*a*, thereby to allow attachment of the cover member 129 in correspondence with the keyhole opening. In this way, maintenance operation is facilitated through the facilitation of insertion of the oil filter 130 into the opening 128.

Numeral 132 denotes an outlet pipe which extends from a pump 133 of the work oil tank 17 and under the battery 18 and the side frame 22 to be eventually connected with the hydraulic pump for the engine 13.

On the top of the right side frame 22, there are provided erect a plurality of retaining pins 134*a* for allowing temporary retention of the work oil tank 17 by these retaining pins 134*a*. These retaining pins 134*a* and apertured retaining members 134*b* provided in the work oil tank 17 to be retained thereto together constitute tank temporary fixing means 134.

Further, the work oil tank 17 temporarily fixed by the temporary fixing means 134 can then be fixed permanently by a permanent attaching means 136. This permanent fixing means 136 includes a rod 135*d* extending in the fore-aft direction and retained by a substantially L-shaped (in front view) retained member 135*e* fixed on the top face of the work oil tank 17 and a retaining member 135*a* to be fastened to opposed ends of the rod 135*d* by means of nuts 135*e*. Then, the lower end of the retaining member 135*a* is hooked to the apertured retaining member 139*a* attached to the right side frame 22 and a bracket 139*b* and then the nuts 135*e* are fastened, whereby the work oil tank 17 is drawn toward the right side frame 22. With this, the permanent attachment is completed.

The permanent attaching means 136 may alternatively be constructed such that the work oil tank 17 is fixed to the right side frame 22 by means of fastening members such as bolts.

Between the bottom face of the right side frame 22 and the extension portion 17*a*, there is provided a cushion member 137 formed of e.g. rubber, so that the work oil tank 17 may be supported with its top face being oriented substantially horizontal.

Figure 8:
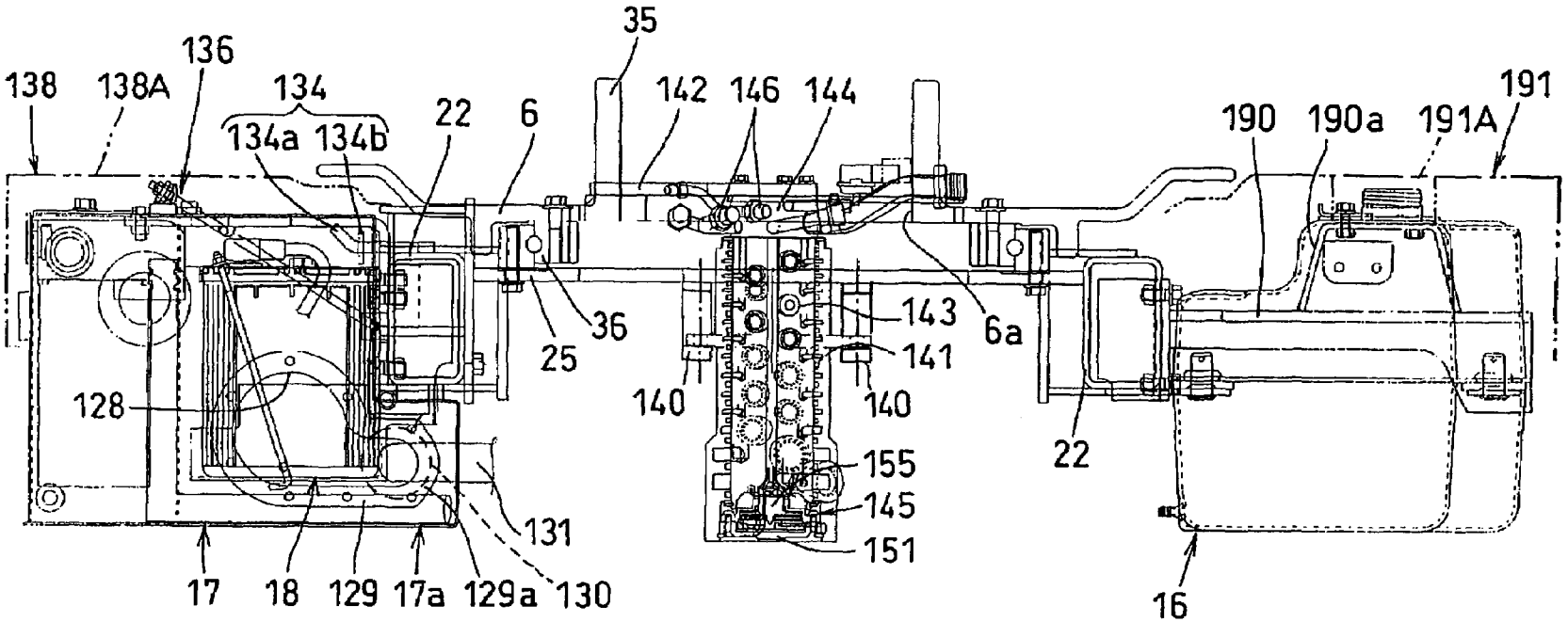
FIG. 8 is a central section view.
Figure 9:
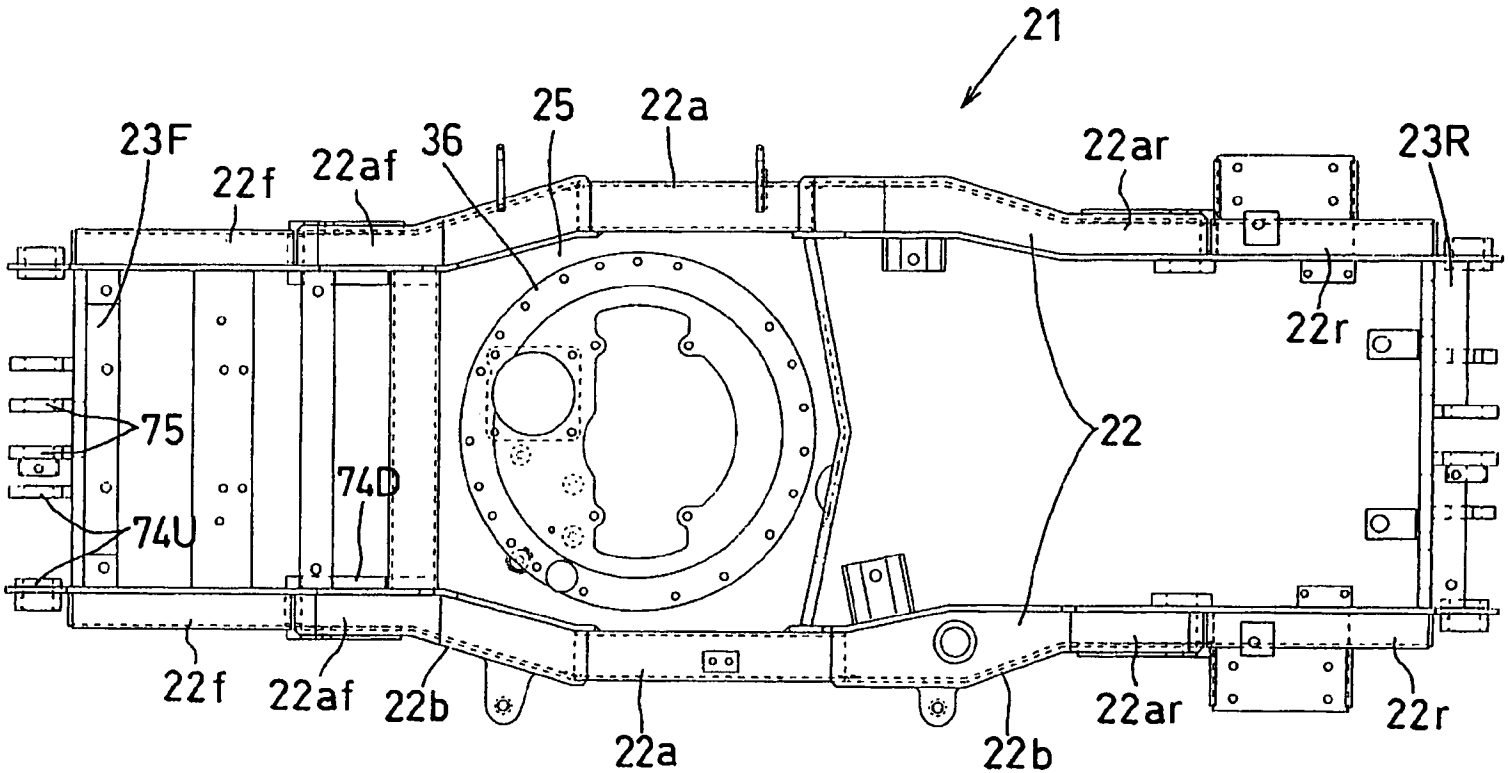
FIG. 9 is a plan view of a vehicle frame.

The work oil tank 17, as denoted with two-dot lines in FIG. 8, is covered with a cover 138 having an outer face and an upper face which are substantially reversed-L shaped in the front view. This cover 138 is formed of a metal plate or plastic and is attached via e.g. a mount to the front and rear portions of the work oil tank 17 by brackets 139*b* fixed to the right side frame 22. The upper horizontal portion of this cover 138 provides a step portion 138A.

The fuel tank 16 is formed of plastic or plate metal and is fixed to the outer face of the left side frame 22.

More particularly, to the outer face of the left side frame 22, there are attached a pair of front and rear brackets 190 extending outward in the right and left directions, and to and between these front and rear brackets 190, the fuel tank 16 is attached.

This fuel tank 16, like the work oil tank 17 described above, may have a substantially L-shape (in plan view) having an extension portion extending under the side frame 22, so that the tank may be attached via a tank temporary retaining means and tank permanent attaching means.

Further, like the work oil tank 17, the top face and the outer face of the fuel tank 16 are covered with a cover 191. This cover 191 is attached to the brackets 190 via mounts 190*a*. The top horizontal portion of this cover 191 provides a step portion 191A.

Incidentally, the covers 138, 191 may be provided as flat plates covering only the top faces of the tanks 17, 16 and/or may be secured to the tanks 17, 16.

As shown in FIGS. 1–4, 6, 7, 12 and 13, the traveling body 4 has a portion thereof downwardly of the swivel base 6 provided as a flat portion 4A and a further portion thereof rearwardly of the swivel base 6 as a raised portion 4B. To this raised portion 4B, an engine hood 80 is detachably attached to be opened and closed.

Within the engine hood 80 attached to the raised portion 4B of the traveling body 4, the engine 13 is mounted and in the flat portion 4A thereof, the power transmission mechanism 14 is mounted. And, the swivel base 6 is disposed upwardly of the flat portion 4A housing the power transmission mechanism 14. The engine 13 projects downwardly of the swivel base 6.

The engine 13 may be disposed with the axis of its crank shaft 13A being oriented along the right and left direction. In this case, however, the engine 13 is disposed along the fore and aft direction, with the right-and-left center 13S (see FIG. 3) thereof being substantially aligned with or slightly offset to one side (left side) from the right-and-left center of the vehicle frame 21 (extending through a center 5S of the swivel shaft 5).

The radiator 62 disposed rearwardly of the engine 13 may alternatively be disposed at the right-and-left center of the vehicle frame 21. In this case, however, the radiator 62 is disposed with offset to the same side as the engine 13.

The power transmission mechanism 14 disposed at the flat portion 4A can be a mechanical transmission mechanism. In this case, however, this mechanism 14 is provided as combination of a hydrostatic transmission (HST) 26 including a pump 81 and a motor 82, and a reduction device 87. As shown in FIGS. 3, 4, 12 and 13, a transmission case 83 for this hydrostatic transmission 26 supports an input shaft 27 for the pump 81 for receiving the power from the engine 13 and an output shaft 28 of the motor 82. And, these shafts are respectively aligned substantially with the fore and aft direction in the plan view. The transmission case 83 of the transmission 26 and front and rear cases 87A, 87B of the reduction device 38 are assembled together and the input shaft 27 and the output shaft 28 are disposed with slightly forward-downward inclination in the side view thereof.

The reduction device 87 accommodates, inside the front and rear cases 87A, 87B thereof, two sets of reduction gears 107, 108. Each of the front and rear cases 87A, 87B has a short vertical width and a long right-and-left width. The front case 87A includes a charge pump 109 and a hydraulic clutch 110 controlled by this charge pump 109.

The input shaft 27 projects forwardly and rearwardly from the transmission case 83, with its rear portion being coupled via a flywheel to the crank shaft 13A and its front portion is supported to the rear case 87*b* of the reduction device 87 and mounts a gear 107A of the reduction gear set 107 and is operable for driving the charge pump 109.

The gear 107A of the reduction gear set 107 is meshed with a gear 107B and this gear 107B is mounted on a clutch input shaft 111 of the hydraulic clutch 110. Between this clutch input shaft 111 and a clutch output shaft 112 of the hydraulic clutch 110, there is provided a clutch means 113 which can be engaged/disengaged by the pressure oil fed from the charge pump 109.

The clutch output shaft 112 drives, via a universal joint shaft, the hydraulic pump 85 for feeding work oil of a large load.

The charge pump 109 is comprised of e.g. a trochoid pump. When the engine 13 is driven, this pump 109 feeds the pressure oil of a predetermined pressure to the clutch means 113 to keep it engaged. When the engine 13 is stopped, the charge pump 109 is also stopped, thereby to disengage the clutch means 113. Accordingly, for a start-up of the engine 13, this may be done without applying the load from the hydraulic pump 85 to the clutch output shaft 112. Hence, the start-up load can be reduced advantageously.

The output shaft 28 of the motor 82 mounts a gear 108A of the reduction gear set 108. This gear 108A is meshed with a gear 108B mounted on a propelling shaft 114. The propelling shaft 114 projects forwardly and rearwardly of the front and rear cases 87A, 87B of the reduction device 87 to be connected respectively via front and rear universal joint shafts 29F, 29R to bevel pinion shafts 86F, 86R of the front differential unit 64F and the rear differential unit 64R.

In this way, by using the front and rear universal joint shafts 29F, 29R for power transmission to the front and rear wheels 2, 3, even if the bevel pinion shafts 86F, 86R are offset in the right-and-left direction from the center pin 65, or the propelling shaft 114 is inclined downward forwardly, the power transmission to the front and rear differential units 64 is still allowed and the vertical pivotal movements of the front axle cases 63F are allowed also.

In FIGS. 1 through 7, the traveling body 4 mounts thereon the swivel bearing 36 for swivelably supporting the swivel base 6, a ring gear 88 attached along the inner periphery of the swivel bearing 36, a drive pinion 89 meshing with this ring gear 88, and a hydraulic swivel motor 15 for driving the drive pinion 89 for swiveling the swivel base 6.

The swivel shaft 5 mounted at the center 5S of the swivel bearing 36 is constructed as a swivel joint, so that connections of work oil passages connecting the hydraulic pump 85 to the ground-work implement 9, pilot oil passages connecting the manipulating unit and selector valves, electric cables interconnecting the steering unit 8 and the traveling drive unit 12 and so on can be carried out even during the swiveling movement of the swivel base 6.

The above-described components including the swivel motor 15, the universal joint shafts 29, and the hydraulic pump 85 constitute some parts of the power transmission mechanism 14 of the traveling drive unit 12. And, these components are disposed at a level lower than the top face of the vehicle frame 21 and higher than the bottom end of the engine 13 in a compact manner not only in the vertical direction, but also in the fore-and-aft and right-and-left directions.

The components including the swivel base 6, the driver's seat 7 disposed at the rear upper portion of the swivel base 6 of the swivel shaft 5, the steering unit 8 disposed at the front portion of the swivel base 6 forwardly of the driver's seat 7, the manipulating unit 55 disclosed around the driver's seat 7 for manipulating the ground-work implement 9 and so on together constitute the upper structure 11.

The center 5S of the swivel shaft 5 is slightly offset to the forward side from the center P of the axes of the front and rear wheels 2, 3. And, relative to this swivel shaft 5, the operator's seat 7 is disposed on the rear side of the swivel base 6 and the steering unit 8 and the ground-work implement 9 are disposed on the forward side thereof, respectively. The front end of the upper structure 11 is constructed as the steering unit 8 and the rear portion thereof is constructed as the driver's seat 7, and a hydraulic control valve 56 of the manipulating unit 55 is disposed rearwardly of the driver's seat 7.

In the upper structure 11, the swivel bearing 36 and the swivel base 6 are disposed lower than the upper end of the engine 13 disposed at the rear portion of the traveling body 4, and of the swivel bearing 36 and the swivel base 6, at least the swivel baring 36 is disposed at a position between the front and rear wheels 2, 3 and lower than the upper ends of at least either one of the front and rear wheels 2, 3.

In its plan view, the swivel base 6 is flat at its front portion and is substantially circular at its rear and right and left side portions. The rear portion is disposed adjacent the engine 13. When the base 6 is oriented forwardly, the front portion is substantially aligned with the rear ends of the right and left front wheels 2. When the base 6 is swiveled, its outer periphery becomes overlapped in the fore-and-aft direction with the rear ends of the right and left front wheels 2. And, this swivel base 6 projects sideways to the right and left from the vehicle frame 21 to be overlapped in the right and left direction with the fuel tank 16 and the work oil tank 17, respectively.

That is, the swivel base 6 is formed such that it has a progressively larger area defined by three points of the engine 13 disposed substantially right-and-left center and the pair of front wheels 2 disposed apart therefrom on the right and left sides. Or, after securing a necessary area for the swivel base 6, the fore-and-aft dimension and the right-and-left dimension of the traveling body 4 are set as compact as possible.

And, since the traveling body 4 mounts thereon such components as the engine 13, the fuel tank 16, the work oil tank 17, the selector valves 54 etc., this traveling body 4 has a significant weight, whereby the weight of the upper structure 11 is reduced correspondingly and its fore-and-aft and right-and-left dimensions may also be small.

With the above-described construction, relative to the weight of the traveling body 4 having the front and rear wheels 2, 3, the total weight of those components mounted therein such as the swivel base 6, the driver's seat 7 on the swivel base 6, the steering unit 8 and the ground-work implement 9, or the total weight of at least the swivel base 6 and the driver's seat 7 and the steering unit 8 mounted thereon may be smaller.

Further, the arrangement of the power transmission mechanism 14 around the swivel shaft 5 and also the above-described triangular arrangement of the engine 13, the fuel tank 16 and the work oil tank 17, etc. all help improve the weight balance around the swivel shaft 5. Further, as the engine 13 is disposed at the rear portion of the traveling body 4, the selector valves 54 are disposed at the front portion and the work oil tank 17 and the fuel tank 16 are disposed on the right and left sides thereof, the weight balance in all directions is improved.

The gravity center Q of the work vehicle 1 is located slightly forwardly of the center 5S of the swivel shaft 5 and adjacent the rear end of the hydraulic pump 85 in the fore/aft direction and is located also adjacent the top faces of the swivel base 6 and the swivel bearing 36 in the right/left direction. Further, in the right/left direction, this gravity center Q is located at a position slightly offset to the right relative the center 5S and overlapped with the swivel motor 14.

In this work vehicle 1, in order to improve the traveling stability, the working stability, etc. by lowering the gravity center Q of the traveling body 4, the engine 13 is disposed on the traveling body 4. Further, in order to dispose the swivel base 6 at a lowest possible position in spite of the engine 13 being mounted on the traveling body 4, the engine 14 is mounted at the rear portion of the traveling body 4. Further, by disposing the power transmission mechanism 14 forwardly of the engine 13, the vertical dimension of the traveling body 4 under the swivel base 6 is reduced advantageously.

A distance L1 measured from the center 5S of the swivel shaft 5 and the rear end of the upper structure 11 is set to be within a distance L2 measured from the center 5S of the swivel shaft 5 and the rear ends of the rear wheels 3 or at least within a distance L3 measured from the center 5S of the swivel shaft 5 and the rear end of the traveling body 4. With this, when the upper structure 11 is swiveled, this will not hit an object which may be present rearwardly.

As shown in FIGS. 8, 12, 14, 16 and 17, the swivel joint (swivel shaft) 5 includes a cylindrical member 141 fixed to the vehicle frame 21 of the traveling body 4 via a bracket 140, and a center shaft 143 rotatably mounted inside the cylindrical portion 141 and non-rotatably attached to the swivel base 6 via a stopper plate 142. At an upper portion of this center shaft 143, there is provided an oil passage connecting annular member 144 connected to an actuator. Downwardly of the cylindrical member 141 and the center shaft 143, there is provided (electric) current-carrying means 145.

The cylindrical member 141 has a large surface area. Hence, various pipes are connected thereto with appropriate peripheral and axial spaces therebetween. More particularly, from the top to the bottom of the cylindrical member 141, this member 141 defines a pilot connection opening 141*j*, a hydrostatic transmission 26 connection opening 141*e*, an oil pressure signal connection opening 141*n*, a brake connection opening 141*h*, a power steering cylinder 71 left connection opening 141*c*, a power steering cylinder 71 right connection opening 141*d*, a dozer actuator cylinder 78 elevating connection opening 141*f*, a dozer actuator cylinder 78 lowering connection opening 141*b*, a swivel motor 15 right swiveling connection opening 141*i*, a swivel motor 15 left swiveling connection opening 141*g*, an auxiliary hydraulic motor connection opening 141*k*, a main connection opening 141*m*, a drain 141*t*, etc.

Inside the center shaft 143, there is formed an oil passage communicating the respective connection openings of the cylindrical member 141 to the oil passage connecting annular member 144 via radial oil passages and axial oil passages. Hence, to the oil passage connecting annular member 144, there are connected pipes communicating with these oil passages. Incidentally, the center shaft 143 and the oil passage connecting annular member 144 may be formed integrally.

Although the oil passage connecting annular member 144 may define various connection openings to be connected with pipes, this will require an area for defining these connection openings as large as that of the cylindrical member 141. For this reason, in the instant embodiment, the pipes are integrally welded in the form of a multi-directional piping arrangement on the surface of the oil passage connecting annular member 144.

This oil passage connecting annular member 144 projects upward from the swivel bearing 36 into the swivel base 6. In particular, the swivel base 6 includes right and left raised ribs 35, so it is difficult for the multi-directional piping arrangement 146 to project from the oil passage connecting annular member 144 in the right/left directions. For this reason, the piping arrangement 146 is bent in the middle thereof to be oriented in the fore-aft direction.

The piping arrangement 146 is disposed lower than the top face of the raised ribs 35 and the swivel base 6 defines an opening 6*a* for introducing a hose connecting between the piping arrangement 146 and the upper structure 11.

The center shaft 143 defines a through hole 147 along the axis thereof, into which a harness 148 is inserted. The bottom face of the center shaft 143 defines an engaging recess 150 for engagement with a coupling 149.

To the bottom of the cylindrical member 141, there is detachably attached a joint cover 151 and a case member 152 is attached to an upper portion of this joint over 151 and the current-carrying means 145 is disposed between the case member and the joint cover 151.

To a fixed side of the joint cover 151 or of the case member 152, there is fixed a stationary current-carrying member 153 such as a brush, which comes into sliding contact with a movable current-carrying member 154 for establishing electric connection therewith.

The movable current-carrying member 154 is disposed under a rotary shaft 155 coaxial with the center shaft 143 and rotatably supported to the case member 152. And, the coupling 149 is fitted to an upper portion of this rotary shaft 155 projecting from the case member 152 and this coupling 149 is inserted into the engaging recess 150 to be engaged with the center shaft 143, whereby the rotary shaft 155 is rotated together with the center shaft 143.

The harness 148 has its one end connected to an electric controller mounted on the swivel base 6 and the other end inserted into the rotary shaft 155 to be connected with the movable current-carrying member 154, whereby electric current supply to the engine 13 and various electromagnetic valves mounted on the traveling body 4 is controlled via the stationary current-carrying member 153.

The current-carrying means 145 is used mainly for carrying electric current for control signals, but may be used for supplying electric power for driving motors.

On the swivel base 6, an implement support unit 37 is provided erect at a front portion and a rear wall portion 34 is provided erect at a rear portion of the base. And, the right and left raised ribs 35 provided erect at the intermediate portion of the base 6 connect the implement support unit 37 with the rear wall portion 34, whereby the entire swivel base 6 is formed as a strong three-dimensional structure.

Referring to FIG. 1 and FIGS. 4–7, there is provided a driver's seat mounting frame 51 which extends rearward from the upper portion of the rear wall portion 34 of the swivel base 6 and projects over and above the engine 13. To form this driver's seat mounting frame 51, a pair of right and left transverse pipe members 51B are secured to an attaching plate 51A secured to the top face of the rear wall portion 34 and vertical pipe members 51C project rearward from the right and left transverse members 51B and the right and left vertical members 51C are connected via a plurality of connecting members 51D. Then, this driver's seat mounting frame 51 mounts the driver's seat 7 at a front portion thereof and also mounts at rear portions thereof the hydraulic control valve 56 of the controller 55, an electric generator 159 having an auxiliary hydraulic motor 158 and a battery 160.

At an upper portion of the implement support unit 37 of the swivel base 6, there are provided a pair of right and left support members 38. This support member 58 includes a hooked-shaped member 58A and a horizontal transverse pipe member 58B projecting from the member 58A. The hooked members 58A are bolt-fixed to the implement support unit 37 and the transverse members 58B form a pair of right and left ROPS support portions.

The right and left transverse members 51B of the driver's seat mounting frame 51 also constitute the ROPS support portions. To the transverse member 51B and the transverse member 58B disposed one in front of the other, front and rear struts 52F, 52R of the right and left ROPS 53 are connected and supported.

Referring more particularly to the ROPS 53, its portion from the rear strut 52R to the upper portion 52U is formed by bending a single pipe member in the substantially U-shape and the upper portion 52U and the upper end of the front strut 52F are connected to each other. Then, these right and left ROPS 53 are connected via a plurality of connecting rods 60 and a canopy 90 is attached to the upper portion 52U for sun beam shading.

To the bottom ends of the front and rear struts 52F, 52R, connecting members 59F, 59R are fixedly attached. Each of these connecting members 59F, 59R includes a connecting portion in the form of a pipe or a solid bar and an elbow portion for disposing this connecting portion to the strut 52 perpendicularly. As the connecting portions are inserted into the transverse members 51B, 58B and these are fixed by means of bolts extending through both the connecting portions and the members, the ROPS 63 may be attached to the swivel base 6.

Incidentally, the connecting portions may be connected with the transverse members 51B, 58B through engagement therewith, or both of these may be formed of plate members, angle members, etc.

Each of the right and left rear struts 52R is bent in an L-like shape, so that the strut extends from the rear wall portion 34 of the swivel base 6 to a position rearward and upward of the driver's seat 7 and then extends upward from its intermediate portion, whereby this strut projects upwardly of the engine 13 together with the driver's seat mounting frame 51.

Accordingly, the driver's seat mounting frame 51 and the operator's seat 7 are disposed at a position higher than the engine 13, so that the swivel base 6 when being swiveled, can pass above the engine 13, that is, pass above the raised portion 4B which forms the highest portion of the traveling body 4.

With the above-described arrangements of mounting the engine 13 on the rear portion of the traveling body 4 and disposing the driver's seat 7 at the position projecting rearwardly and upwardly from the swivel base 6, on the swivel base 6, the driver's seat 7 is disposed on the rear portion thereof and also the steering unit 8 is disposed on the front portion thereof. Consequently, the weight of the upper structure 11 is reduced significantly and its fore-and-aft dimension may be the necessity minimum dimension.

And, the area of the swivel base 6 forwardly of the operator's seat 7 may be efficiently utilized as a space reserved for the driver and the swivel base 6 may be disposed within a limited area and at a low position, so that the entire work vehicle 1 may be formed compact in the fore-and-aft direction, the right-and-left direction and the vertical direction as well.

The driver's seat mounting frame 51 supports right and left lever manipulating means 55L, 55R of manipulating units 55 disposed on the right and left sides of the operator's seat 7 for manipulating the ground-work implement. These right and left lever manipulating units 55L, 55R are for manipulating a boom cylinder 43, an arm cylinder 45, an implement cylinder 47 etc. of the ground-work implement 9 to be described later and the swivel motor 15, etc.

Further on the right and left side of the driver's seat 7, there are disposed a manipulating lever 181 for the swing cylinder 41 of the ground-work implement 9, a manipulating lever 182 for a tilt cylinder 184 of the implement 46, and a manipulating lever 183 for the dozer actuating cylinders 78. There are also provided other components such as a hand accelerator lever 187 for operating a governor of the engine 13 and traveling lock levers 188 for operating the traveling lock valve 178. The traveling lock levers 188 are disposed on the right and left sides of the driver's seat 7.

Rearwardly of the driver's seat mounting frame 51 and on the right and left sides of the hydraulic control valve 56, there are disposed remote control valves for the swing, tilt and dozers to be manipulated by the manipulating levers 181, 182, 183, these valves being connected with the respective manipulating levers 181, 182, 183 via a link, a rod, a cable, etc.

For allowing the high-speed vehicle run on the road, the steering unit 8 includes the steering wheel 73 and a steering controller 73A of the steering wheel 73 and other associated components are attached to a support member 38 mounted erect on the swivel base 6 and rearwardly of the implement support unit 37, so that these components may be mounted on the swivel base 6 as an assembly.

Figure 18:
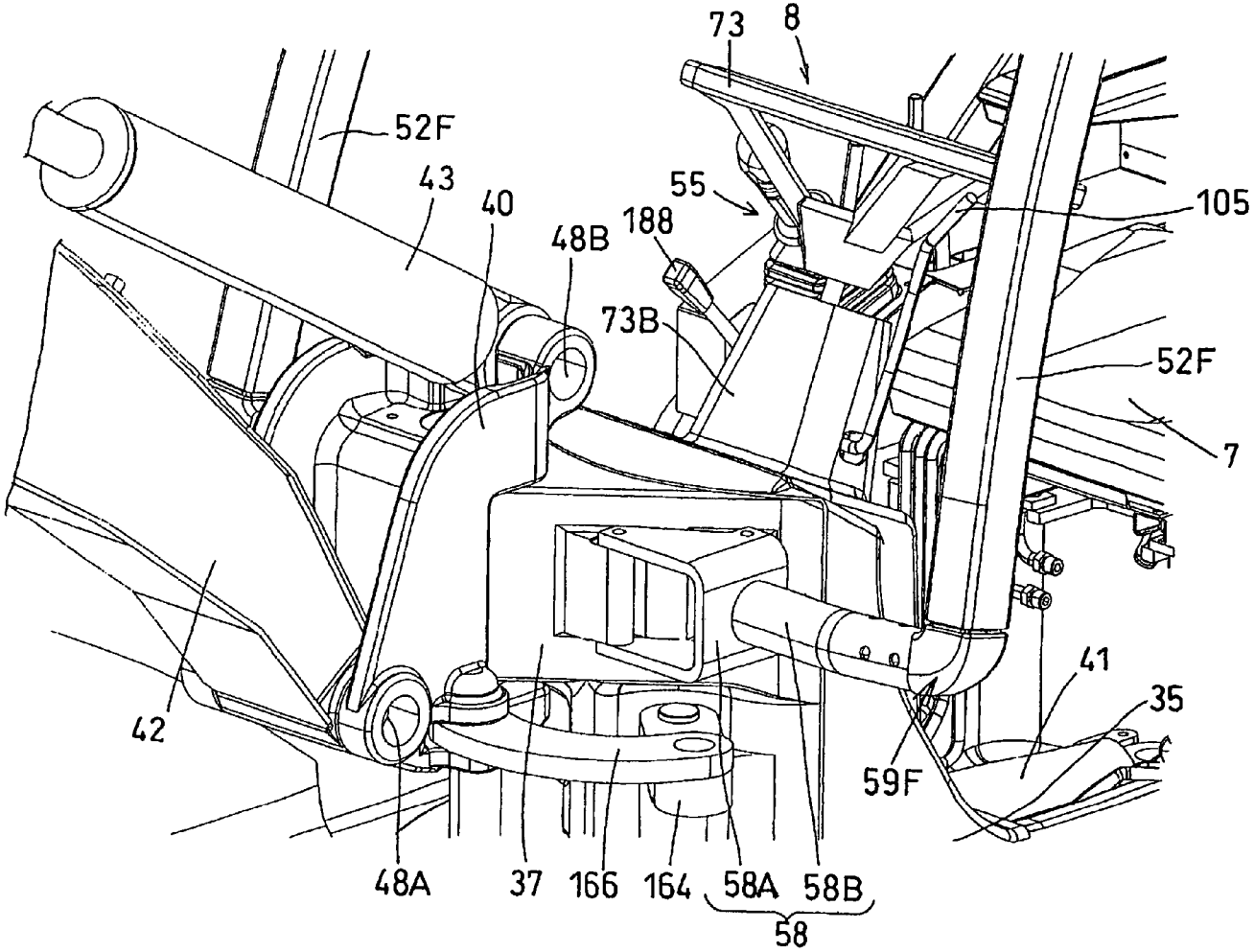
FIG. 18 is a perspective view showing a front portion of an upper structure.
Figure 19:
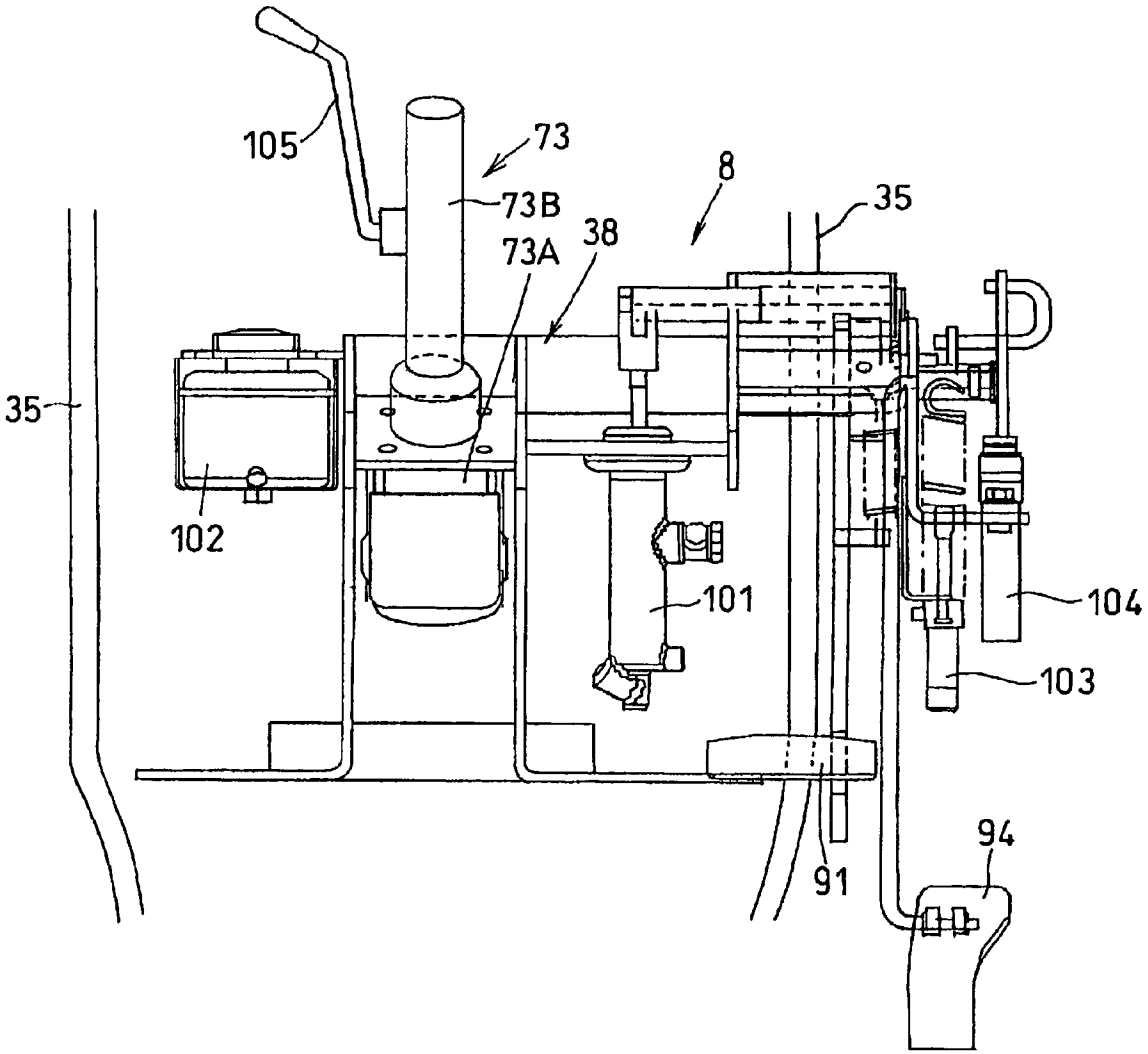
FIG. 19 is a rear view of a steering unit, FIG. 20 a side view of the steering unit.
Figure 20:
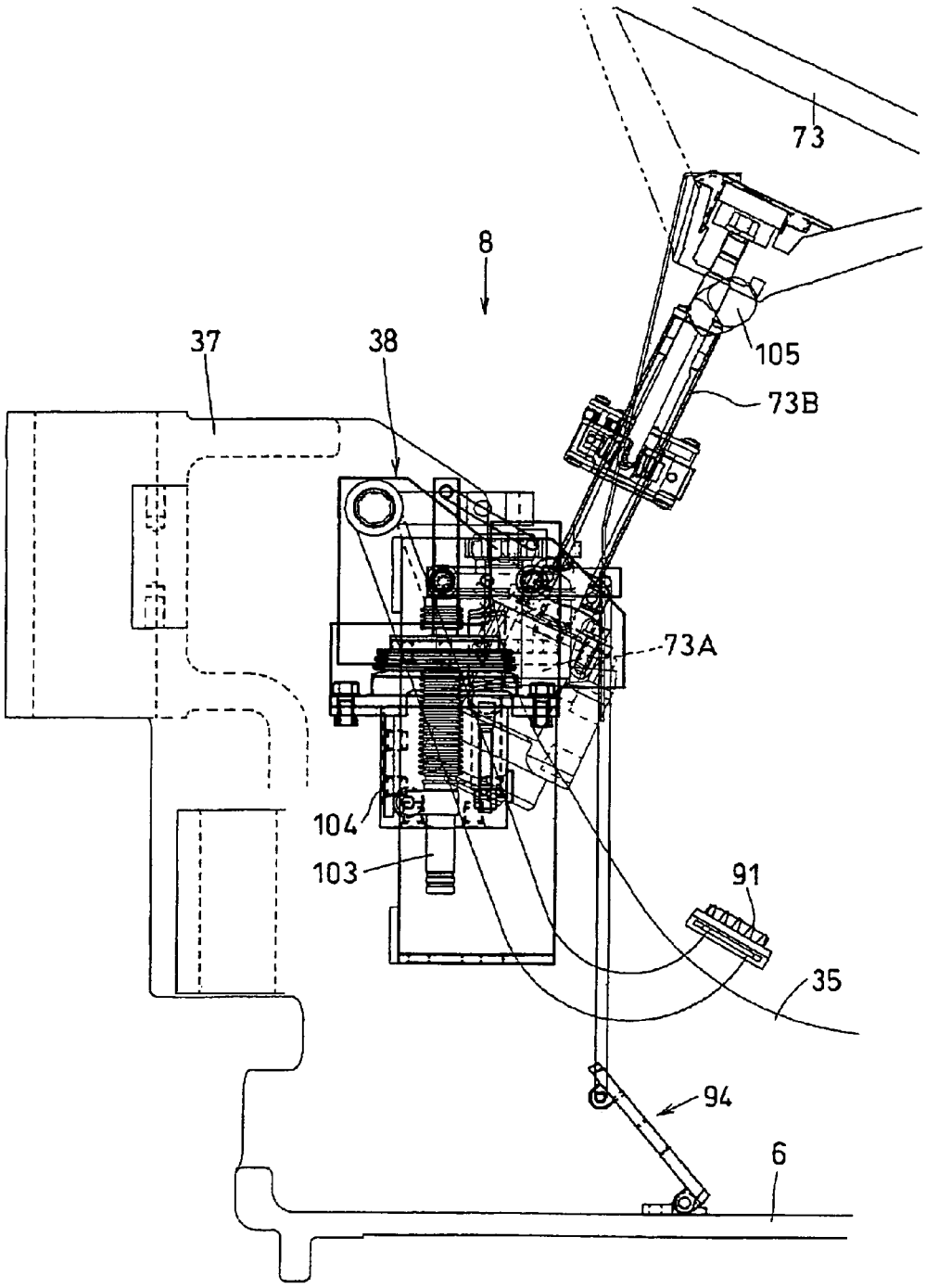

More particularly, as shown in FIGS. 18 through 20, in addition to the steering controller 73A, the support member 38 pivotally supports also a change-speed pedal 94 for operating the hydrostatic transmission 26 for change-speed, which pedal 94 is disposed near a position where the driver's right foot is to be placed, and pivotally supports a brake pedal 91 in its vicinity. In addition, there are attached a master cylinder 101 and an oil tank 102 for operating the brake mechanism A as well as such other components as a damper 103 for the change-speed pedal 94 and a remote control valve 104 for the HST.

Along a handle post 73B of the steering wheel 73, there is disposed a shuttle lever 105 for operating a forward/reverse switch valve 174.

The swivel base 6 mounts, at its front portion, the implement support unit 37 which supports the ground-work implement 9 with allowing the implement 9 to be pivoted to the right and left above the swivel base 6. While the steering wheel 73 of the steering unit 8 is disposed at the substantially right-and-left center of the front portion (may be offset to the left) of the swivel base 6, the implement support unit 37 is disposed with offset to the right so as to provide better visibility of the operating condition of the ground-work implement 9.

As shown in FIGS. 1–4 and 18, the implement support unit 37 is disposed erect at the front portion of the swivel base 6 so as to connect the front ends of the right and left raised ribs 35 as well as to cover the front side of the steering unit 8 and supports a swing shaft 39 provided as a vertical shaft. This swing shaft 39 pivotally supports a swing member 40 which is pivoted by a swing cylinder 41. The swing member 40 pivotally supports a boom 42 and a boom cylinder 43 for lifting up/down this boom 42 via horizontal shafts 48A, 48B.

The swing member 40 is pivotally supported to an upper portion of the implement support unit 37 and a rotary shaft 163 as a vertical shaft is pivotally supported to a lower portion of the implement support unit 37. To this rotary shaft 163, an upper arm 164 and a lower arm 165 are secured, with the upper arm 164 being connected to the swing member 40 via a link 166 and the lower arm 165 being connected to the swing cylinder 41, so as to act as a start-up coupling means for transmitting operational force of the lower swing cylinder 41 to the upper swing member 40.

The portion of the swing member 40 pivotally supporting the lower boom 42 projects radially from the outer periphery (outer peripheral swiveling path) of the swivel base 6. The portion of the swing member 40 pivotally supporting the base of the upper boom cylinder 43 is located substantially above the swing shaft 39 and within the outer periphery of the swivel base 6.

The implement support unit 37 is disposed so as to be substantially confined within the outer periphery of the swivel base 6 and the unit 37 has a height so set as to allow the boom 42 and the boom cylinder 43 to pass above the highest position of the traveling body 4. Hence, even when the boom 42 is swiveled rearward, this will not come into contact with the front portion of the hood cover 80 as long as the boom 42 assumes an upper posture than the horizontal.

That is to say, when the ground-work implement 9 on the swivel base 6 is swiveled, this will not collide the traveling body 4. Therefore, the vehicle can carry out a ground work with the swivel base 6 assuming the backward posture. Hence, the ground work such as an excavating work is possible over the entire movable range of the traveling body 4.

The ground-work implement 9 includes, at the leading end of the boom 42, an arm 44 which is vertically pivotable by an arm cylinder 45. And, at the leading end of this arm, there is provided an implement (bucket or the like) 46 which can be pivoted up and down by the implement cylinder 47.

The implement 46 has its right-to-left center portion supported to be pivotable about a fore-and-aft shaft and has right and left side portions vertically pivotable by the tilt cylinder 184.

Figure 21:
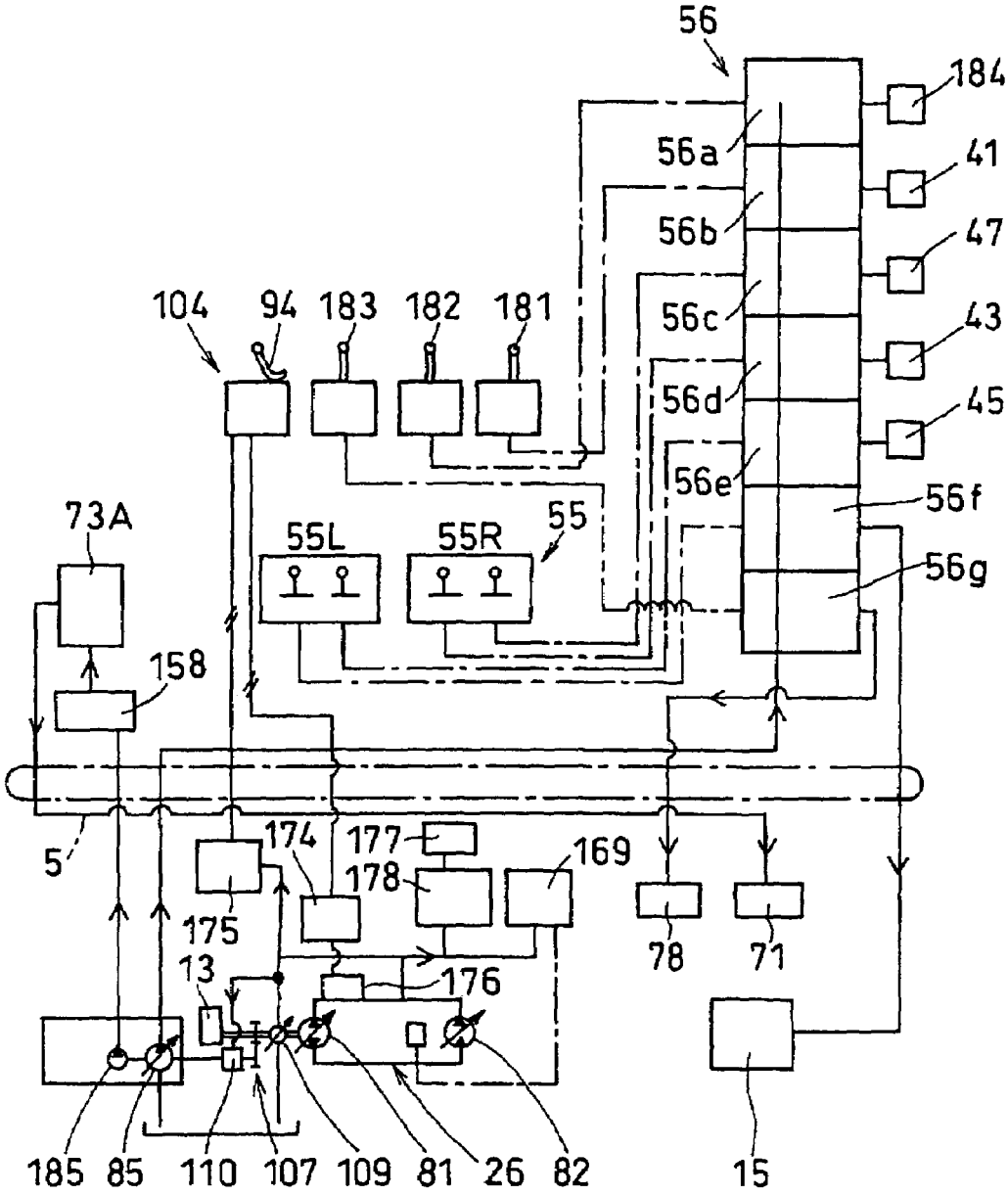
FIG. 21 is a hydraulic circuit diagram of the entire work vehicle.
Figure 22:
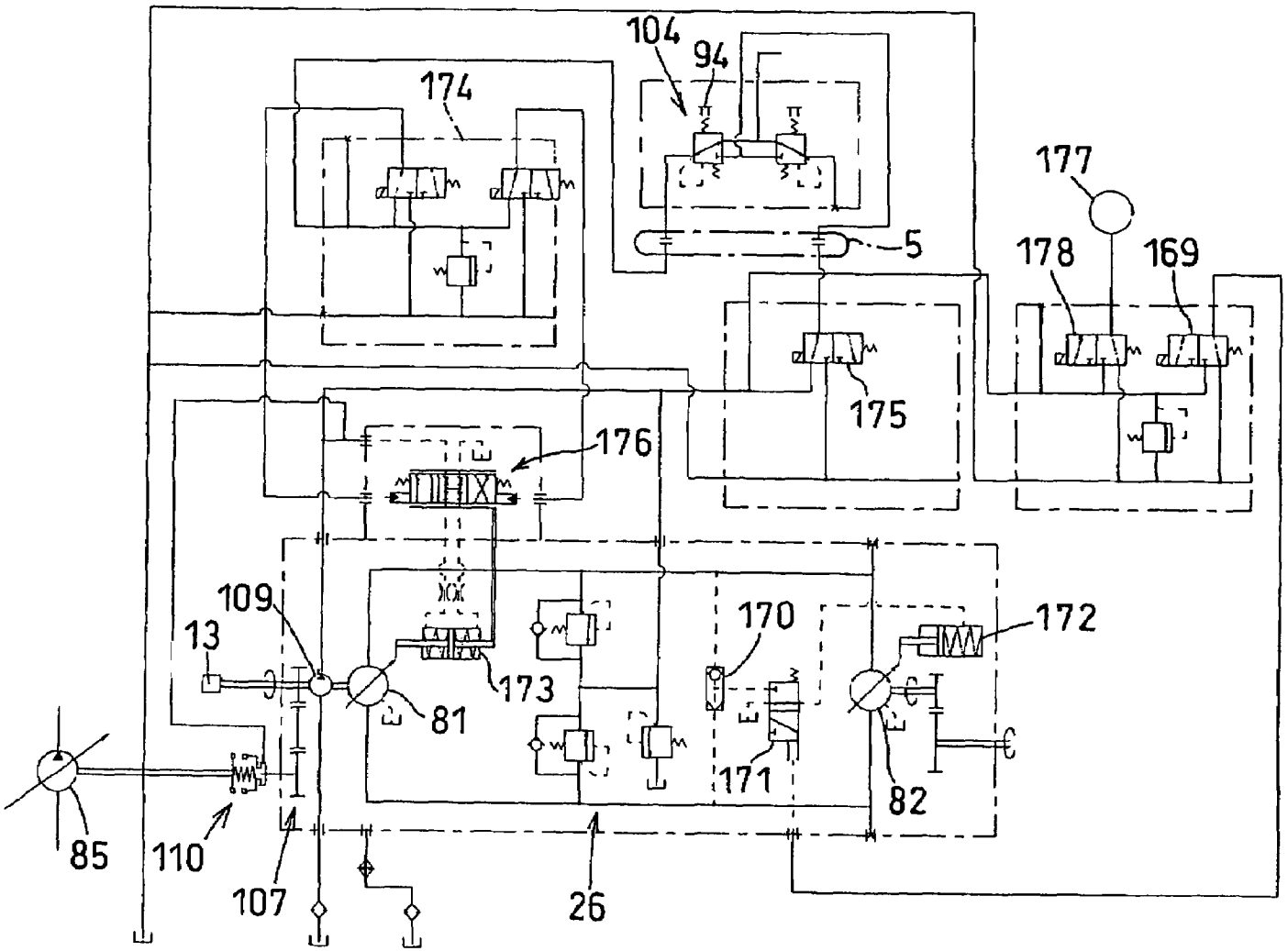
FIG. 22 is a hydraulic circuit diagram of the transmission.

FIGS. 21 and 22 show the hydraulic circuit of the wheeled work vehicle 1. This circuit is divided across the swivel joint (shaft) 5 between a section for the traveling body 4 and a further section for the upper structure 11.

The power of the engine 13 drives the pump 81 of the transmission 26 and drives also the charge pump 109. This power is capable of driving also the hydraulic pump 85 via the reduction gear set 107 and the hydraulic clutch 110.

The transmission 26 includes a shuttle valve 170 and a high/low speed switchover valve 171 which is operable by an electromagnetic valve 169 to operate a swash-plate control actuator 172 of the motor 82, thereby to selectively realize a high-speed condition and a low-speed condition.

The pump 81 is connected to a speed actuator 173 for switching over forward/reverse drive modes and the speeds thereof. This speed actuator 176 is switched over between the forward drive mode and the reverse drive mode by a forward/reverse selector valve 174 and can be controlled by a remote control valve 104 operable by the change-speed pedal 94.

The work oil from the charge pump 109 flows through the traveling lock valve 175 to reach the remote control valve 104 and then flows from this remote control valve 104 to either the forward driving side or the reverse driving side of the forward/reverse selector valve 174. Hence, according to an amount of the driver's stepping operation on the change-speed pedal 94, the speed control valve 176 is operated correspondingly to control the speed actuator 173.

The numeral 177 denotes the differential lock mechanism, which is operable to check or not check the work oil from the charge pump 109 by a differential lock selector valve 178, thereby to selectively provide a differential locked condition and a differential released condition.

The work oil from the hydraulic pump 85 is fed to the hydraulic control valve 56 comprising an assembly of a plurality of valve elements 56*a*–56*g*. Then, the oil is supplied through the respective valve elements 56*a*–56*g* of the hydraulic control valve 56 to the respective actuators.

The left lever manipulating means 55L of the manipulating unit 55 includes remote control valves for the arm and for swiveling for operating the arm cylinder 45 via the arm valve element 56*e* for a scraping or dumping operation and for operating the swivel motor 15 via the swivel valve element 56*f* for right or left swiveling.

The right lever manipulating means 55R includes remote control valves for the implement and the boom for operating the implement cylinder 47 via the implement valve element 56*c* for a tilting/dumping operation and operating the boom cylinder 43 via the boom valve element 56*d* for elevating/lowering movement.

Adjacent the left and right lever manipulating means 55L, 55R (or adjacent the steering unit 8), the three manipulating levers 181, 182, 183 are arranged. The manipulating lever 181 is for operating the remote control valve for the swing, i.e. for operating the swing cylinder 41 for right or left pivotal movement via the swing valve element 56*b*. The manipulating lever 182 is for operating the remote control valve for the tilt, i.e. for operating the tilt cylinder 184 via the tilt valve element 56*a*. The manipulating lever 183 is for operating the remote control valve for the dozers, i.e. operating the dozer operating cylinder 78 for upward/downward movement via the dozer valve element 56*g*.

The hydraulic pump 85 is connected to an auxiliary pump 185. The work oil of this auxiliary pump 185 is fed to an auxiliary hydraulic motor 158 and then via the steering controller 73A to the steering hydraulic cylinder 71.

In summary, the transmission 26, the swivel motor 15, the pumps 109, 85, 185, the steering hydraulic cylinder 71, the dozer operating cylinder 78, the traveling lock valve 175, the selector valves 54, etc. are all mounted on the traveling body 4. Whereas, the manipulating unit 55, the change-speed pedal 94, the steering controller 73A, the three manipulating levers 181, 182, 183, the auxiliary hydraulic motor 158, the hydraulic control valve 56, etc. are mounted on the upper structure 11. And, the work oil can be supplied/discharged vertically via the swivel joint 5. Further, via the current-carrying means 145 provided at the swivel joint 5, control signals for the electromagnetic valves for controlling the transmission 26 and the other electromagnetic valves and the other electric devices can be transmitted from the upper structure 11 to the traveling body 4.

The forward/reverse switch valve 174, the traveling lock valve 175, the differential lock switch valve 178, the electromagnetic control valve 169, etc. are mounted as the selector valves 54 at the front portion of the traveling body 4 and constitute the hydraulic system together with the pumps 109, 85, 185, etc.

Although it is preferred that the wheeled work vehicle 1 include all of the respective components described above, it is also possible for the vehicle to include some of them selectively or in different combinations.

For instance, the traveling body 4 having the front and rear wheels 2, 3 may mount the traveling drive unit 12 and the dozers 10 and the swivel base 6 may be disposed at a position lower than the uppermost position of the traveling body 4, thereby to allow the full-angle swiveling movement of the base 6. And, on this swivel base 6, the upper structure 11 having the driver's seat 7 and the steering unit 8 and the ground-work implement 9 may be mounted. With this basic construction, according to the present invention, the vehicle may include at least one of the following features (a) through (g).

(a) The upper structure 11 and the ground-work implement 9 mounted on the swivel base 6 are adapted to be able to pass above the engine 13.

(b) In the traveling body 4, its portion downwardly of the swivel base 6 is formed as the flat portion 4A and its portion rearwardly of the swivel base 6 is formed as the raised portion 4B.

(c) The engine 13 is disposed at the rear portion of the traveling body 4 and the swivel base 6 is disposed at a position lower than the upper end of the engine 13.

(d) Of the swivel bearing 36 and the swivel base 6 at least the swivel bearing 36 is disposed between the front and rear wheels 2, 3 and at a position lower than the upper end of at least one of them.

(e) The implement support unit 37 is disposed substantially within the outer periphery of the swivel base 6.

(f) The driver's seat 7 is disposed to project rearward from the swivel base 6.

(g) The base portion of the ground-work implement 9 supported by the implement support unit 37 is disposed at a position hither than the front and rear wheels 2, 3 and the engine 13.

These features may be used in various combinations also when the basic construction of the wheeled work vehicle 1 is added with the further feature of e.g. setting the total weight of at least the swivel base 6, the driver's seat 7, and the steering unit 8 among the swivel base 6, the driver's seat 7, the steering unit 8 and the ground-work implement 9 to be less than the total weight of the traveling body 4 including the front and rear wheels, 2, 3 or the still further feature of limiting the distance L1 from the swivel shaft 5 to the rear end of the upper structure 11 within the distance L2 from the swivel shaft 5 and the rear wheel 3.

The above-described wheeled work vehicle 1 is suitable for effecting such works as a grading operation on an inclined ground or a limited space for which the skid steering loader is generally not suited. Although this vehicle can effect such work as collecting earth while moving about, the vehicle is good at such operation of collecting earth by the hydraulic power while the vehicle is parked still on the ground. And, with exchange of implements 46 having different widths, this single vehicle can effect both a transporting operation and a ditch digging operation for a depth less than 1.8 m such as for laying a wire under the ground.

That is to say, the grading operations using machinery are divided roughly into the transporting operation and the grading operation. And, this wheeled work vehicle 1 can effect with particularly high efficiency the grading operation which is a non-transporting, earth moving operation, such as for forming a slope or undulation on the ground surface or leveling the ground surface, or collecting the earth, backfilling a ditch or a hole, etc.

The front/rear, right/left and upper/lower positional relations among the respective components employed in the foregoing embodiment are best as shown in FIGS. 1–22. However, the invention is not limited to the foregoing embodiment, but may be varied in many ways by modifying these components or combinations thereof.

For instance, in place of the four-column type ROPS 53 employed in the foregoing embodiment, a two-column type ROPS or a cabin unit may be mounted on the vehicle. The manipulating unit 55 may be disposed adjacent the steering wheel 73. Further, the drive wheels may be replaced by crawlers, while providing the driven wheels as wheels.

In these manners, the invention may be embodied in any other manner as described above. Further changes or modifications will be apparent for those skilled in the art from the foregoing disclosure within the scope of the invention defined in the appended claims.

What is claimed is:

1. A wheeled work vehicle comprising:

a traveling body including front and rear wheels, a traveling drive unit having an engine and a power transmission mechanism, a fuel tank, a work oil tank, and a vehicle frame mounting said front and rear wheels, said traveling drive unit, said fuel tank and said work oil tank;

a swivel base disposed upwardly of the traveling body and mounted via a swivel bearing on the traveling body to be swivelable for full-angle swiveling movement relative thereto;

a driver's seat mounted at a rear portion of the swivel base;

a steering unit disposed forwardly of the driver's seat; and a ground-work implement supported on an implement support unit disposed erect on a front portion of the swivel base;

wherein the vehicle frame includes right and left side frames, a front cross beam for interconnecting the right and left side frames at front portions thereof with a predetermined distance therebetween, and a rear cross beam for interconnecting the right and left side frames at rear portions thereof with a predetermined distance therebetween, each said side frame having a horizontal intermediate portion located at an intermediate portion of the side frame, a horizontal front portion located at the front portion of the side frame and having a higher ground level than the intermediate portion, a horizontal rear portion located at the rear portion of the side frame and having a higher ground level than the intermediate portion, a front transition portion connecting the front portion of the side frame and a front end of the intermediate portion, and a rear transition portion connecting the rear portion of the side frame and a rear end of the intermediate portion;

wherein said vehicle frame has a front region including said front cross beam and said front portion of each said side frame, said front region mounting a front-wheel suspension unit for the front wheels;

wherein said vehicle frame has a rear region including said rear cross beam and said rear portion of each said side frame, said rear region mounting a rear-wheel suspension unit for the rear wheels;

wherein said vehicle frame has an intermediate region located between the front and rear wheels and supporting said swivel bearing;

wherein said front and rear regions are located at a ground level higher than said intermediate region via said respective front and rear transition portions of each said side frame; and wherein a distance between the intermediate portions of the side frames is increased relative to a distance between the front portions of the side frames and also to a distance between the rear portions of the side frames.

2. The wheeled work vehicle according to claim 1 wherein the front portions of the side frames have a higher ground level than the rear portions of the side frames.

3. The wheeled work vehicle according to claim 1, wherein the fuel tank is mounted on either one of right and left intermediate portions of the traveling body and the work oil tank is mounted on the other of the right and left intermediate portions.

4. The wheeled work vehicle according to claim 3, wherein the engine is disposed at the rear portion of the traveling body and the power transmission mechanism is disposed at the intermediate portion of the traveling body.

5. The wheeled work vehicle according to claim 1, wherein the implement support unit of the ground-work implement pivotally supports a swing member via a swing shaft, the swing member pivotally supports a boom via a horizontal shaft and a boom cylinder for lifting the boom up and down is disposed rearwardly of the boom.

6. The wheeled work vehicle according to claim 5, wherein a front portion of the swing member projects radially outward from the swivel base and is set at a height which allows passage of the boom and the boom cylinder above the highest position of the traveling body.

7. The wheeled work vehicle according to claim 1, wherein a driver's seat mounting frame disposed on the swivel base includes a rear upward projecting portion projecting rearward and upward from the swivel base and the driver's seat and a ground-work implement manipulating unit are disposed on said rear upward projecting portion thereby to allow the driver's seat to pass above the traveling body when the swivel base is swiveled.

8. The wheeled work vehicle according to claim 1, wherein each of the driver's seat mounting frame and the implement support unit mounted on the swivel base includes a pair of right and left attaching portions, to which front and rear ends of a roll-over protection system having a substantially angular hooked shape are connected.

9. A wheeled work vehicle comprising:

a traveling body including front and rear wheels, a traveling drive unit having an engine and a power transmission mechanism, a fuel tank, a work oil tank, and a vehicle frame mounting said front and rear wheels, said traveling drive unit, said fuel tank and said work oil tank;

a swivel base disposed upwardly of the traveling body and mounted via a swivel bearing on the traveling body to be swivelable for full-angle swiveling movement relative thereto;

a driver's seat mounted at a rear portion of the swivel base;

a steering unit disposed forwardly of the driver's seat; and a ground-work implement supported on an implement support unit disposed erect on a front portion of the swivel base;

wherein the vehicle frame includes right and left side frames, a front cross beam for interconnecting the right and left side frames at front portions thereof with a predetermined distance therebetween, and a rear cross beam for interconnecting the right and left side frames at rear portions thereof with a predetermined distance therebetween, each said side frame having a horizontal intermediate portion located at an intermediate portion of the side frame, a horizontal front portion located at the front portion of the side frame and having a higher ground level than the intermediate portion, a horizontal rear portion located at the rear portion of the side frame and having a higher ground level than the intermediate portion, a front transition portion connecting the front portion of the side frame and a front end of the intermediate portion, and a rear transition portion connecting the rear portion of the side frame and a rear end of the intermediate portion;

wherein said vehicle frame has a front region including said front cross beam and said front portion of each said side frame, said front region mounting a front-wheel suspension unit for the front wheels;

wherein said vehicle frame has a rear region including said rear cross beam and said rear portion of each said side frame, said rear region mounting a rear-wheel suspension unit for the rear wheels;

wherein said vehicle frame has an intermediate region located between the front and rear wheels and supporting said swivel bearing;

wherein said front and rear regions are located at a ground level higher than said intermediate region via said respective front and rear transition portions of each said side frame; and wherein said front portions of the side frames have a higher ground level than the rear portions of the side frames.

10. The wheeled work vehicle of claim 9, wherein a distance between the intermediate portions of the side frames is increased relative to a distance between front portions of the side frames and also to a distance between the rear portions of the side frames.

11. The wheeled work vehicle according to claim 9, wherein the fuel tank is mounted on either one of right and left intermediate portions of the traveling body and the work oil tank is mounted on the other of the right and left intermediate portions.

12. The wheeled work vehicle according to claim 11, wherein the engine is disposed at the rear portion of the traveling body and the power transmission mechanism is disposed at the intermediate portion of the traveling body.

13. The wheeled work vehicle according to claim 9, wherein the implement support unit of the ground-work implement pivotally supports a swing member via a swing shaft, the swing member pivotally supports a boom via a horizontal shaft and a boom cylinder for lifting the boom up and down is disposed rearwardly of the boom.

14. The wheeled work vehicle according to claim 13, wherein a front portion of the swing member projects radially outward from the swivel base and is set at a height which allows passage of the boom and the boom cylinder above the highest position of the traveling body.

15. The wheeled work vehicle according to claim 9, wherein a driver's seat mounting frame disposed on the swivel base includes a rear upward projecting portion projecting rearward and upward from the swivel base and the driver's seat and a ground-work implement manipulating unit are disposed on said rear upward projecting portion thereby to allow the driver's seat to pass above the traveling body when the swivel base is swiveled.

16. The wheeled work vehicle according to claim 9, wherein each of the driver's seat mounting frame and the implement support unit mounted on the swivel base includes a pair of right and left attaching portions, to which front and rear ends of a roll-over protection system having a substantially angular hooked shape are connected.

17. A wheeled work vehicle comprising:

a traveling body including front and rear wheels, a traveling drive unit having an engine and a power transmission mechanism, a fuel tank, a work oil tank, and a vehicle frame mounting said front and rear wheels, said traveling drive unit, said fuel tank and said work oil tank;

a swivel base disposed upwardly of the traveling body and mounted via a swivel bearing on the traveling body to be swivelable for full-angle swiveling movement relative thereto;

a driver's seat mounted at a rear portion of the swivel base;

a steering unit disposed forwardly of the driver's seat; and a ground-work implement supported on an implement support unit disposed erect on a front portion of the swivel base;

wherein the vehicle frame includes right and left side frames, a front cross beam for interconnecting the right and left side frames at front portions thereof with a predetermined distance therebetween, and a rear cross beam for interconnecting the right and left side frames at rear portions thereof with a predetermined distance therebetween, each said, side frame having a horizontal intermediate portion located at an intermediate portion of the side frame, a horizontal front portion located at the front portion of the side frame and a horizontal rear portion located at the rear portion of the side frame;

wherein said vehicle frame has a front region including said front cross beam and said front portion of each said side frame, said front region mounting a front-wheel suspension unit for the front wheels;

wherein said vehicle frame has a rear region including said rear cross beam and said rear portion of each said side frame, said rear region mounting a rear-wheel suspension unit for the rear wheels;

wherein said vehicle frame has an intermediate region located between the front and rear wheels and supporting said swivel bearing; and wherein said front portions of the side frames have a higher ground level than the rear portions of the side frames.

18. The wheeled work vehicle according to claim 17, wherein a distance between the intermediate portions of the side frames is increased relative to a distance between the front portions of the side frames.

* * * * *